US007543910B2

(12) United States Patent
Suzuki

(10) Patent No.: US 7,543,910 B2
(45) Date of Patent: Jun. 9, 2009

(54) PRINTER AND PRINTING METHOD

(75) Inventor: Katsuhito Suzuki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 270 days.

(21) Appl. No.: 11/592,619

(22) Filed: Nov. 3, 2006

(65) Prior Publication Data

US 2007/0103777 A1 May 10, 2007

(30) Foreign Application Priority Data

Nov. 4, 2005 (JP) ..... P2005-320463
Jan. 26, 2006 (JP) ..... P2006-017365

(51) Int. Cl.
*B41J 23/00* (2006.01)

(52) U.S. Cl. ..... 347/37

(58) Field of Classification Search ..... 347/2, 347/37, 241, 244, 256, 258; 355/22, 33; 359/455, 463, 621, 623; 430/228
See application file for complete search history.

(56) References Cited

U.S. PATENT DOCUMENTS 5,812,152 A * 9/1998 Torigoe et al. ..... 347/2
5,959,718 A * 9/1999 Morton ..... 355/22
6,249,384 B1 * 6/2001 Cobb et al. ..... 359/623
7,192,117 B2 * 3/2007 Suzuki ..... 347/37

FOREIGN PATENT DOCUMENTS

JP B-3471930 5/1996
JP 2005-320461 11/2005

* cited by examiner

*Primary Examiner*—Hai C Pham
(74) *Attorney, Agent, or Firm*—Edwards Angell Palmer & Dodge LLP; John J. Penny, Jr.; Catherine J. Toppin

(57) ABSTRACT

A printer for executing a printing on a lens sheet in which a plurality of lenses is disposed, includes: lens detection device which, by scanning the lens sheet, outputs a lens signal corresponding to a lens resolution of the lenses in the lens sheet; encoder signal output device which, by scanning a scale, outputs an encoder signal in accordance with a pattern provided on the scale; lens signal counting device which calculates first elapsed time information regarding a cycle of the lens signal; encoder signal counting device which calculates second elapsed time information regarding a cycle of the encoder signal; and lens signal division device which, based on the first elapsed time information and the second elapsed time information, divides the lens signal and outputs a divided lens signal.

11 Claims, 13 Drawing Sheets

FIG. 11

| SCORE | L P I |
|---|---|
| 0.9 | 180.1 |
| 1.0 | 180.0 |
| 1.1 | 179.9 |
| . . . | . . . |
| 1.9 | 90.1 |
| 2.0 | 90.0 |
| 2.1 | 89.9 |
| . . . | . . . |
| 2.9 | 60.1 |
| 3.0 | 60.0 |
| 3.1 | 59.9 |
| . . . | . . . |

FIG. 12

| SCORE | NUMBER OF DIVISIONS |
|---|---|
| 0.9 | 1 DIVISION |
| 1.0 | 1 DIVISION |
| 1.1 | 1 DIVISION |
| . . . | . . . |
| 1.9 | 2 DIVISIONS |
| 2.0 | 2 DIVISIONS |
| 2.1 | 2 DIVISIONS |
| . . . | . . . |
| 2.9 | 3 DIVISIONS |
| 3.0 | 3 DIVISIONS |
| 3.1 | 3 DIVISIONS |
| . . . | . . . |

PRINTER AND PRINTING METHOD

BACKGROUND OF THE INVENTION

The present invention relates to a printer and a printing method.

Among various kinds of printing technology, there is one which prints a print image on a recording layer of a lens sheet including a lenticular lens in which a large number of cylindrical convex lenses (hereafter, convex lenses) are disposed in parallel (refer to Japanese Patent No. 3,471,930 (paragraphs 0066 to 0076, FIGS. 1, 5, 8, 9 etc.)). In such a printing technology, a large number of striped subdivided images corresponding to a pitch of the convex lenses (a lens resolution) are aligned and recorded on a recording layer of the lens sheet. Then, it is possible, in accordance with a kind of the subdivided images, to configure in such a way that a visible image is stereoscopically viewed and a picture moves when seen from different angles (animation, etc.; referred to as a variable image).

Meanwhile, as a technical detail of printing directly on the lens sheet furnished with the lenticular lenses, there is one which is disclosed in Patent Document 1. In this patent, in order to absorb a fluctuation in the lens resolution which occurs at the time of manufacturing the lens sheet, a configuration is such as to switch between a lens signal obtained by detecting the lenses of the lens sheet and an encoder signal (an ENC signal). The switching enables an ejection of ink droplets in accordance with the lens resolution.

[Patent Document 1] Japanese Patent No. 3,471,930 (refer to paragraphs 0066 to 0076, FIGS. 1, 5, 8, 9 etc.)

Meanwhile, in the technical detail disclosed in the heretofore described Patent Document 1, there is an advantage that the lens resolution can be automatically determined. However, no details of how to automatically determine the lens resolution are disclosed in the heretofore described Japanese Patent No. 3,471,930. Also, no details of how to carry out the switching between the lens signal and the ENC signal are disclosed, either.

At this point, in the event that a current resolution of the lens sheet is recognized in advance by a printer side, it can be used for a subsequent ink droplet ejection control, motor drive control and the like. However, as described heretofore, no specific method for automatically recognizing the lens resolution exists at present. As a method other than automatically determining the lens resolution on the printer side, there is a method by which an evaluation image and the lens sheet are aligned, and a user visually checks how a moiré occurs at that time and the like, thereby determining the lens resolution. However, in the method, as an examination is carried out by hand, there is a problem in that it takes time and effort.

Also, for example, a method can be considered by which information on the lens resolution is obtained on the user side, based on which the user designates the lens resolution. In this case too, in the same way as the method of using the evaluation image, as a manual operation is required, there is a problem in that it takes time and effort. Also, as another method, a method can also be considered by which a number of lens resolutions usable for the printer is limited to one. However, an optimum lens resolution may often differ depending on a type of print contents in a case of a stereoscopic viewing or a like case, a purpose of exhibition (for appreciation or a POP, etc.), a place of exhibition (indoors or outdoors, etc.), and the like. For that reason, in the event that the number of lens resolutions is limited to one, it is impossible to properly respond to a use application of the lenticular lens.

Also, generally, in the printer, a position of a print head is detected based on an ENC signal outputted from a linear encoder and a rotary encoder. Also, in a case of executing a printing on the lens sheet, a timing signal PTS is generated by multiplying the ENC signal and so on and, based on the timing signal PTS, the print head is controlled and driven, forming a desired print image on the lens sheet.

At this point, in Japanese Patent No. 3,471,930, in view of a variation in the lens resolution, the lens resolution is detected, a lens signal corresponding to the relevant lens resolution is formed, and a drive unit such as the print head is driven based on the lens signal, thus executing a printing on the lens sheet. However, in the printer, as the timing signal PTS is generated based on the ENC signal, although a guarantee of proper operation is given for the drive of the print head based on such a timing signal PTS, in a case of driving the print head based on the lens signal, no guarantee of proper operation (operation stability) is given.

For that reason, even though the print head is driven based on the lens signal to execute the printing on the lens sheet, there is a possibility that a problem occurs, such as an operation instability or a deteriorated image quality. No specific means for solving this kind of problem is disclosed even in Japanese Patent No. 3,471,930. With respect to the drive control based on the ENC signal, not only the print head but, in addition, drive means such as a CR motor and a PF motor are also driven and controlled based on the ENC signal.

SUMMARY

It is therefore an object of the invention to provide a printer and a printing method capable of, as well as automatically recognizing a resolution of a lens sheet, obtaining an operation stability even in a case of driving drive means based on a detected lens signal.

In order to achieve the heretofore described object, according to the invention, there is provided a printer for executing a printing on a lens sheet in which a plurality of lenses is disposed, comprising:

lens detection means which, by scanning the lens sheet, outputs a lens signal corresponding to a lens resolution of the lenses in the lens sheet;

encoder signal output means which, by scanning a scale, outputs an encoder signal in accordance with a pattern provided on the scale;

lens signal counting means which calculates first elapsed time information regarding a cycle of the lens signal;

encoder signal counting means which calculates second elapsed time information regarding a cycle of the encoder signal; and lens signal division means which, based on the first elapsed time information and the second elapsed time information, divides the lens signal and outputs a divided lens signal.

In a case of this configuration, the lens signal counting means calculates the first elapsed time information, while the encoder signal counting means calculates the second elapsed time information. Also, the lens signal division means, based on the first elapsed time information and the second elapsed time information, divides the lens signal and transmits the divided lens signal.

By this means, it is possible to transmit a divided lens signal further segmentalized (divided) than the lens signal outputted by the lens detection means. Also, the lens signal reflects an actual lens resolution of the lens sheet. For this reason, in the event that the drive of a print head or the like is controlled based on the divided lens signal, as well as it being possible to improve a printing accuracy by reflecting the lens resolution, it is possible to realize a fine printing by dividing the lens signal.

The lens signal division means may include: a signal division processor which, by dividing the first elapsed time information by each of a plurality of integers, outputs the divided lens signal corresponding to each integer; score calculation means which calculates a score which is a ratio of the first elapsed time information to the second elapsed time information; and a signal selector which, based on the score calculated by the score calculation means, selects the integer corresponding to the score from among a plurality of the divided lens signals, and selects and outputs the divided lens signal corresponding to the integer.

In a case of this configuration, the signal division processor outputs divided lens signals corresponding to a plurality of integers. Also, the score calculation means, as well as calculating a score which is a ratio of the first elapsed time information to the second elapsed time information, based on the score, selects an integer corresponding to the score from among a plurality of the divided lens signals. Also, the signal selector selects and outputs a divided lens signal corresponding to the integer. By this means, in the event that the heretofore described integer approximates the score, the divided lens signal is placed in a condition in which a cycle is approximated to the encoder signal. Accordingly, even though the print head or the like is controlled and driven using the divided lens signal in place of the encoder signal, as the cycle is approximate, it is possible to print in a condition in which a printing property of the printer on the lens sheet is not significantly changed.

The lens signal division means may include: a correlation recorder which stores a first table showing a correlation between the score and the lens resolution of the lens sheet; search means which searches for a value of the lens resolution corresponding to the score from inside the first table; and a result recorder which stores a search result searched by the search means. The signal selector, based on the search result stored in the result recorder, may select the integer.

In a case of this configuration, when the score is calculated, a lens resolution value corresponding to the score is searched for from inside the first table by the search means. Then, the search result is recorded in the result recorder. Also, the signal selector, based on the search result (the lens resolution value) recorded in the result recorder, determines an integer for dividing the lens signal. By that means, in the event of referring to the first table showing the correlation between the score and the lens resolution, the lens resolution is automatically determined. For that reason, it is also possible, based on the determined lens resolution, to unambiguously determine the integer for dividing the lens signal. Furthermore, as the lens resolution and the integer are determined simply by referring to the correlation between the score and the lens resolution, there is no more dependence on a carriage speed or the like, making it unlikely to suffer from an effect of a speed fluctuation of the carriage. Also, as the lens resolution is automatically calculated, it eliminates a need for an operation such as a user's inputting of the lens resolution, and it is possible to improve a user-friendliness.

The lens signal division means may includes: a correlation recorder which stores a second table showing a correlation between the score and a number of divisions; search means which searches for the number of divisions corresponding to the score from inside the second table; and a result recorder which stores a search result searched by the search means. The signal selector may read the integer stored in the result recorder, and select the divided lens signal.

In a case of this configuration, when the score is calculated, a lens resolution value corresponding to the score is searched for from inside the second table by the search means. Then, the search result (the number of divisions) is recorded in the result recorder. Also, the signal selector reads the search result (the number of divisions) recorded in the result recorder, and makes it an integer for dividing the lens signal. By that means, in the event of referring to the second table showing the correlation between the score and the number of divisions, the lens resolution is automatically determined. In addition, the number of divisions is also instantaneously determined. Furthermore, as the number of divisions is determined simply by obtaining the score, there is no more dependence on the carriage speed or the like, making it unlikely to suffer from the effect of the speed fluctuation of the carriage. Also, as the number of divisions is automatically calculated, it eliminates a need for an operation such as the user's inputting of the lens resolution for determining the number of divisions, and it is possible to improve the user-friendliness.

The lens signal, after being corrected by lens signal correction means based on a subdivided encoder signal obtained by dividing the encoder signal, may be divided by the lens signal division means, generating the divided lens signal.

In a case of this configuration, the lens signal correction means, based on the subdivided encoder signal, corrects the lens signal outputted from the lens detection means, and outputs a corrected lens signal.

By this means, by the lens signal being corrected based on the encoder signal-based subdivided encoder signal, the corrected lens signal generated based on the subdivided encoder signal, rather than a pure lens signal, acts as a reference for all drive timings of the drive means. For this reason, it is possible to prevent an occurrence of a problem in that the operation stability cannot be obtained due to the drive timing of drive means such as the print head not matching the lens signal. Also, as the corrected lens signal is created by correcting the lens signal based on the subdivided encoder signal, a signal switching between the encoder signal and the lens signal is smoothened in a drive portion such as the print head.

The lens signal correction means may include: an ENC subdivision processor into which the encoder signal is inputted and which outputs the subdivided encoder signal; and a correction processor into which the subdivided encoder signal is inputted and which corrects the lens signal based on the inputted subdivided encoder signal and outputs a corrected lens signal.

In a case of this configuration, the ENC subdivision processor subdivides the encoder signal and outputs the subdivided encoder signal. Also, the correction processor, based on the subdivided signal, corrects the lens signal outputted from the lens detection means, and outputs the corrected lens signal.

By this means, as the lens signal is corrected based on the subdivided encoder signal, the corrected lens signal generated based on the subdivided encoder signal acts as a reference for all the drive timings of the drive means. For this reason, it is possible to prevent an occurrence of a problem in that the operation stability cannot be obtained due to the drive timing of drive means such as the print head not matching the lens signal. Also, as the corrected lens signal subjected to the correction reflects even information on the lens signal to be corrected, it is possible to print while reflecting an actual lens pitch. For that reason, it is possible to improve the printing accuracy on the lens sheet. Also, as the corrected lens signal is created by correcting the lens signal based on the subdivided encoder signal, the signal switching between the encoder signal and the lens signal is smoothened in a drive unit such as the print head.

The lens signal division means and the ENC subdivision processor, based on a counting of clock signals, may output the divided lens signal and the subdivided encoder signal.

In a case of this configuration, the clock signal is normally in a condition in which a cycle is very short, compared with that of the lens signal and the encoder. For this reason, based on such a clock signal having the short cycle, it will be possible to subdivide the lens signal into cycles of a desired size.

The encoder signal output means may be a linear encoder for carrying out a position detection in a main scanning direction of a print head which ejects ink droplets toward the lens sheet, and the scale may be a linear scale disposed along the main scanning direction. The lens detection means, while moving in the main scanning direction in conjunction with the linear encoder, may detect the lens resolution of the lenses in the lens sheet along the main scanning direction.

In a case of this configuration, the linear encoder and the lens detection means move in the main scanning direction simultaneously. At the time of this movement, the linear encoder carries out the position detection in the main scanning direction, while the lens detection means carries out the lens resolution detection in the main scanning direction. By this means, it is possible to correlate the lens pitch and the position detected by the linear encoder, and it is possible to generate the divided lens signal based on the first elapsed time information and the second elapsed time information.

The divided lens signal outputted after being selected by the signal selector may be inputted into control means, and the control means may control a drive of the print head which ejects ink droplets toward the lens sheet.

In a case of this configuration, the control means, based on the divided lens signal, controls and drives the print head, ejecting ink droplets toward the lens sheet. By that means, while reflecting the lens pitch, it is possible, based on the encoder signal-based subdivided lens signal, to execute the printing on the lens sheet, and it is possible to realize a high resolution printing while guaranteeing the proper operation.

The printer lens detection means may include: a light emitter which emits light toward the lens sheet, and which is provided opposite a carriage across the lens sheet in a condition in which the lens sheet is transported; and a light receiver which is attached to the carriage, in which the light transmitted through the lens sheet is entered after being emitted from the light emitter, and which outputs a detection signal corresponding to an intensity of the incident light.

In a case of this configuration, the lens detection means, as it has the light receiver disposed on the carriage side across the lens sheet, and the light emitter on a side opposite to it, configures a transmissive sensor. For that reason, compared with a case of using a reflective sensor, it is possible to improve a lens pitch detection accuracy. Also, as a lens signal of high detection accuracy can be obtained, the printing on the lens sheet is provided with a higher resolution.

According to the invention, there is also provided a printing method for executing a printing on a lens sheet in which a plurality of lenses is disposed, comprising:

by scanning the lens sheet, outputting a lens signal corresponding to a lens resolution of the lenses in the lens sheet;

by scanning a scale, outputting an encoder signal in accordance with a pattern provided on the scale;

calculating first elapsed time information on a cycle of the lens signal;

calculating second elapsed time information on a cycle of the encoder signal; and, based on the first elapsed time information and the second elapsed time information, dividing the lens signal and outputting a divided lens signal.

In a case of this configuration, a lens signal output process, by scanning the lens sheet, outputs a lens signal corresponding to the lens resolution. Also, an encoder signal output process, by scanning the scale, outputs an encoder signal in accordance with the pattern. Also, a lens signal subdivision process, based on the first elapsed time information and the second elapsed time information, divides the lens signal and outputs the divided lens signal.

By this means, it is possible to output a divided lens signal further subdivided than the lens signal outputted in a lens signal detection process. Also, the lens signal reflects the actual lens pitch of the lens sheet. For this reason, in the event that the drive of the print head or the like is controlled based on the divided lens signal, as well as it being possible to improve the printing accuracy by reflecting the lens resolution, it is possible to realize the fine printing by subdividing the lens signal.

BRIEF DESCRIPTION OF THE DRAWINGS

FIG. 5 is a sectional side view showing a configuration of the lens detecting sensor and the like;

FIG. 11 shows a table having correlation between a score and a lens resolution;

FIG. 12 shows a table having correlation between the score and a number of divisions;

DETAIL DESCRIPTION OF PREFERRED EMBODIMENTS

First Embodiment

Hereafter, a description will be given of a first embodiment of a printer according to the invention, based on FIGS. 1 to 14. Although a printer 10 of the embodiment is an inkjet printer, as long as such an inkjet printer is an apparatus capable of a printing by ejecting ink, an apparatus employing any ejecting method is acceptable.

In the following description, a lower side refers to a side on which the printer 10 is installed, and an upper side refers to a side away from the side on which it is installed. Also, a direction in which a carriage 30 to be described hereafter moves is a main scanning direction, and a direction perpendicular to the main scanning direction, in which a lens sheet 12 is transported, is a sub-scanning direction. Also, a description will be made designating a side which is fed with the lens sheet 12 as a paper feed side (a rear end side), and a side from which the lens sheet 12 is discharged as a paper discharge side (a front side).

<Regarding Lens Sheet>

Figure 1:
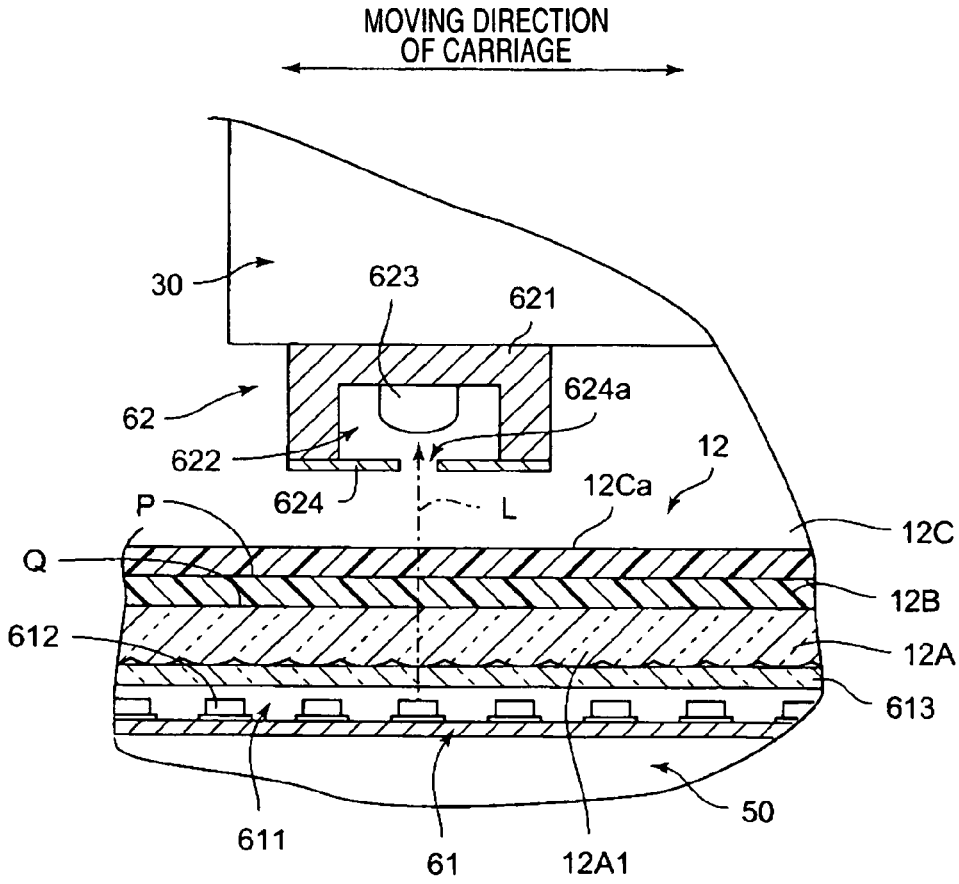
FIG. 1 is a sectional front view showing a configuration of a lens detecting sensor of a first embodiment.

First, a description will be given of the lens sheet 12 which is a printing subject. As shown in FIG. 1, the lens sheet 12 includes a lenticular lens 12A positioned on a first surface, an ink absorbing layer 12B in contact with a second surface of the lenticular lens 12A, and an ink permeating layer 12C positioned on a second surface of the lens sheet 12. Of these, the lenticular lens 12A has a configuration in which a plurality of cylindrical convex lenses (convex lenses 12A1) longitudinal in one direction is disposed in parallel at a fixed pitch. In the lenticular lens 12A, a curvature of the convex lenses 12A1 is formed in such a way that a focal point of light traveling through each convex lens 12A1 is positioned on the second surface of the lenticular lens 12A (an interface Q with the ink absorbing layer 12B).

In the embodiment, as an array pitch of the convex lenses 12A1 in the lenticular lens 12A, there is one having an integral multiple of an array pitch of line patterns on a scale 81 to be described hereafter. For example, in the event that the line patterns on the scale 81 have a pitch of 1/180 inch, as the pitch of the convex lenses 12A1, there is one having 10 lpi (lens per inch; a number of the convex lenses 12A1 per inch), 20 lpi, 30 lpi, 45 lpi, 60 lpi, 90 lpi, 100 lpi, 130 lpi or 180 lpi. However, the pitch of the convex lenses 12A1 not being limited to the exemplified ones, it is acceptable to change it into various pitches other than these lens pitches. Also, in the lens sheet 12, normally, a slight deviation from the heretofore described pitch of the convex lenses 12A1 occurs due to a manufacturing error or the like.

Also, the ink permeating layer 12C is a portion to which ink droplets ejected from a nozzle 33*a* adhere first, and is a portion which the adhering ink permeates. The ink permeating layer 12C is formed from, for example, titanium oxide, silica gel, PMMA (a metacrylic resin) or barium sulfide as a material. Also, the ink absorbing layer 12B is a portion which absorbs the ink which has permeated the ink permeating layer 12C, and/or causes it to be firmly fixed therein. The ink absorbing layer 12B is formed from, for example, particles of a hydrophilic polymer resin, such as a PVA (polyvinyl alcohol) resin, a cationic compound, silica or the like as a material. As well as the ink absorbing layer 12B being transparent, the ink permeating layer 12C is white. However, it being acceptable that the ink absorbing layer 12B is white, it is also acceptable that the ink permeating layer 12C is transparent, and furthermore, it is acceptable that both of the ink permeating layer 12C and the ink absorbing layer 12B are transparent. Also, it is acceptable that the ink permeating layer 12C does not exist.

<Regarding Overall Configuration of Printer>

Figure 2:
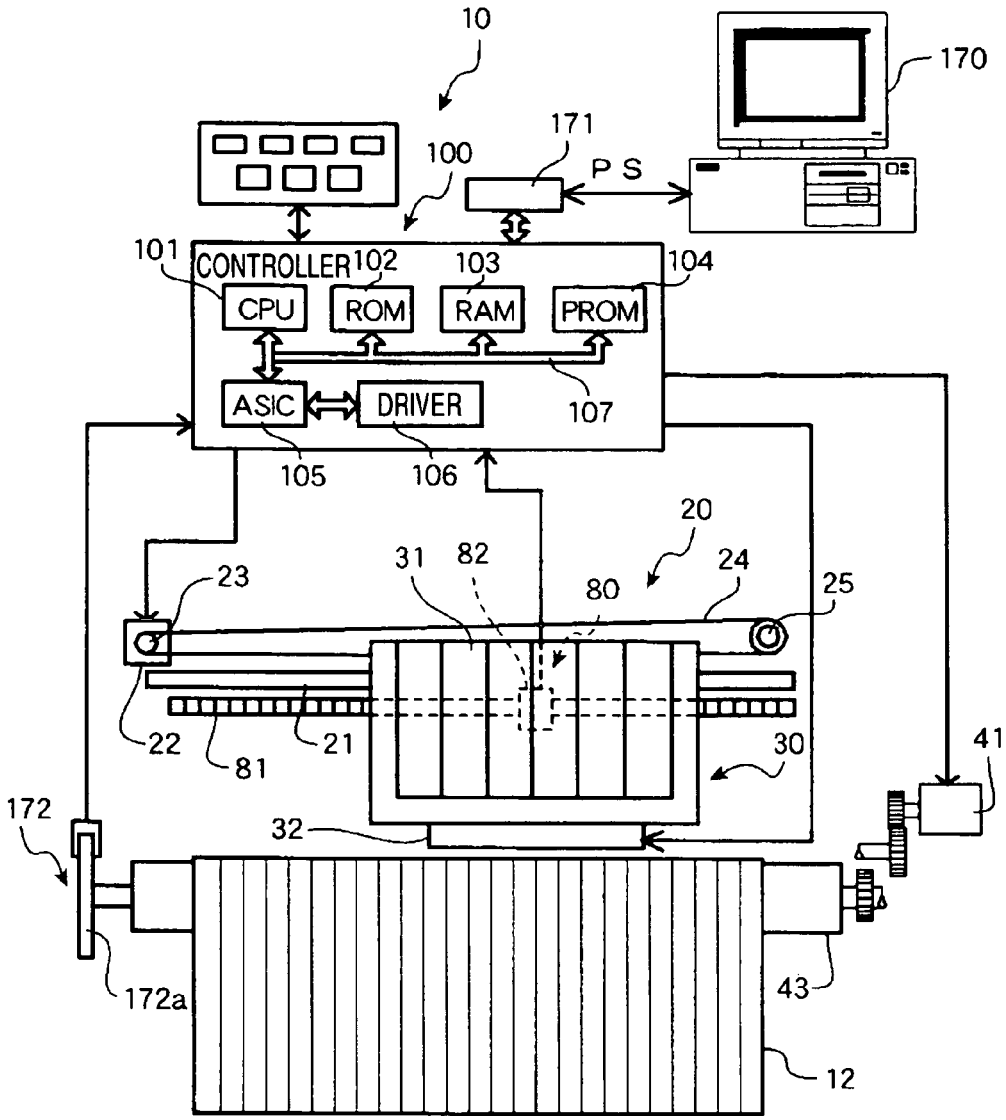
FIG. 2 is a schematic diagram showing a configuration of a printer.

Also, as shown in FIG. 2 etc., in the printer 10, there are a carriage mechanism 20, which causes the carriage 30 to reciprocate in the main scanning direction by means of a carriage motor (a CR motor 22), a paper transporting mechanism 40, which transports the lens sheet 12 by means of a PF motor 41 (corresponding to a paper feed motor), and the like, in addition to which a controller 100 shown in FIG. 2 exists.

At this point, a description will be given of the carriage mechanism 20. The carriage mechanism 20, as shown in FIG. 2 etc., includes the carriage 30. Also, the carriage mechanism 20 includes a carriage shaft 21 slidably holding the carriage 30, the carriage motor (the CR motor 22), a gear pulley 23 attached to the CR motor 22, an endless belt 24, a driven pulley 25 having the endless belt 24 stretched between it and the gear pulley 23, and a linear encoder 80.

Figure 3:
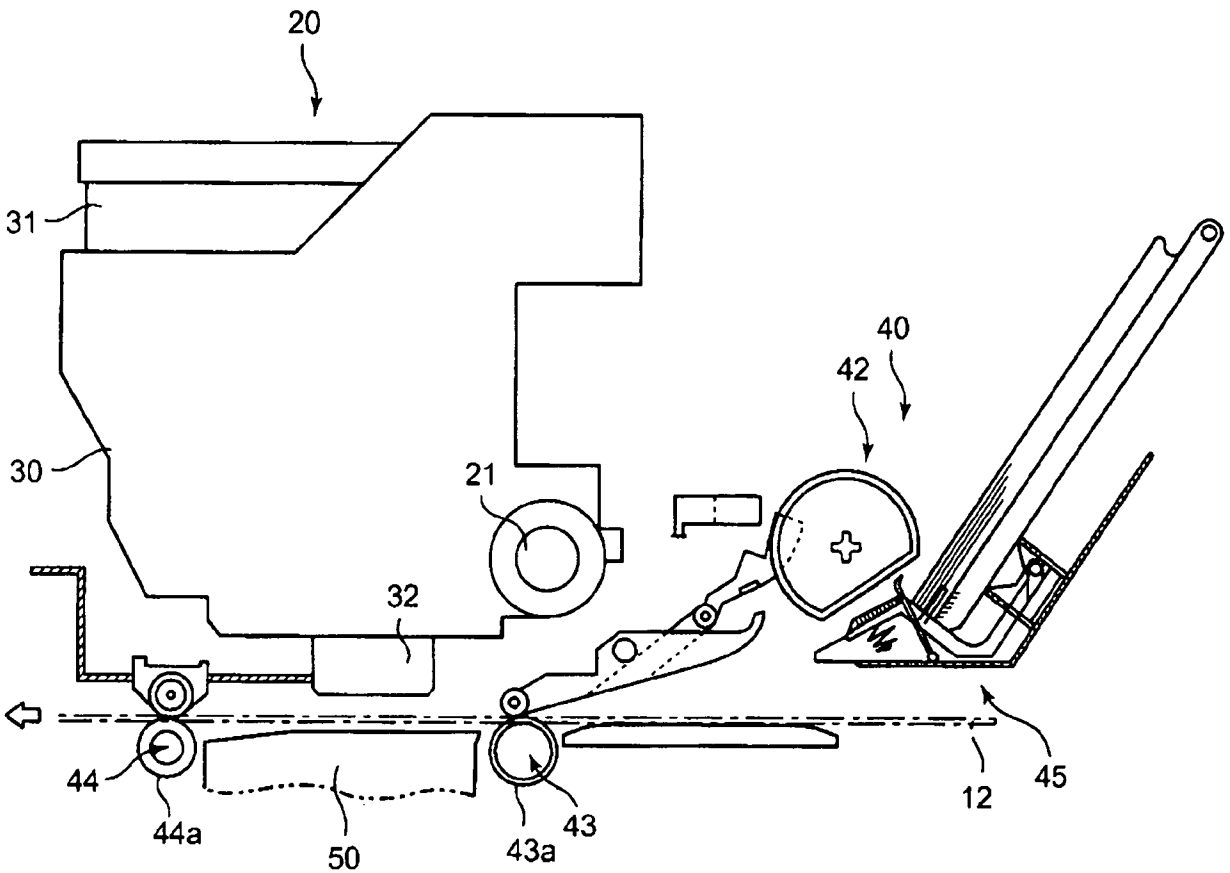
FIG. 3 is a sectional one-side view of a portion involved in a paper transporting of the printer.
Figure 4:
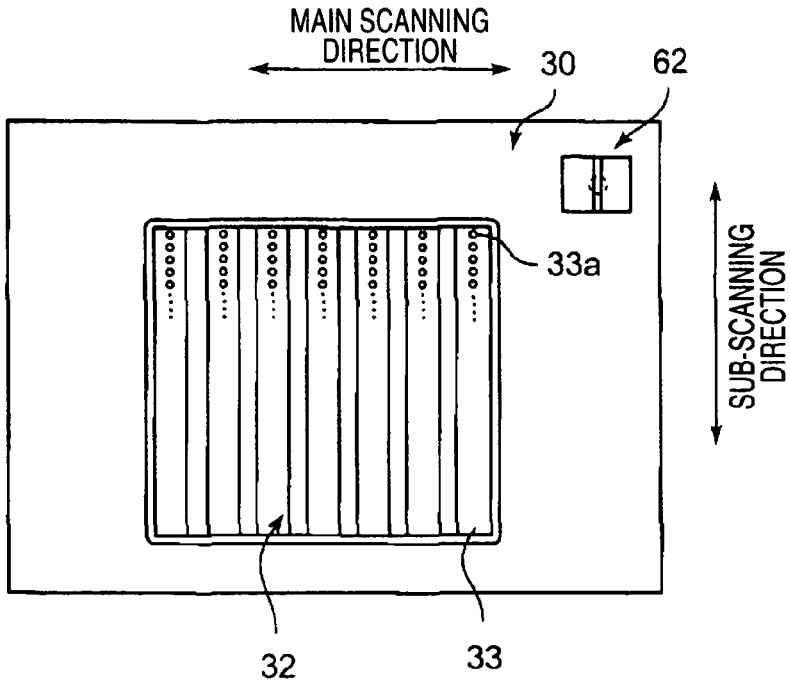
FIG. 4 is a bottom view showing a lower surface of a carriage.
Figure 5:
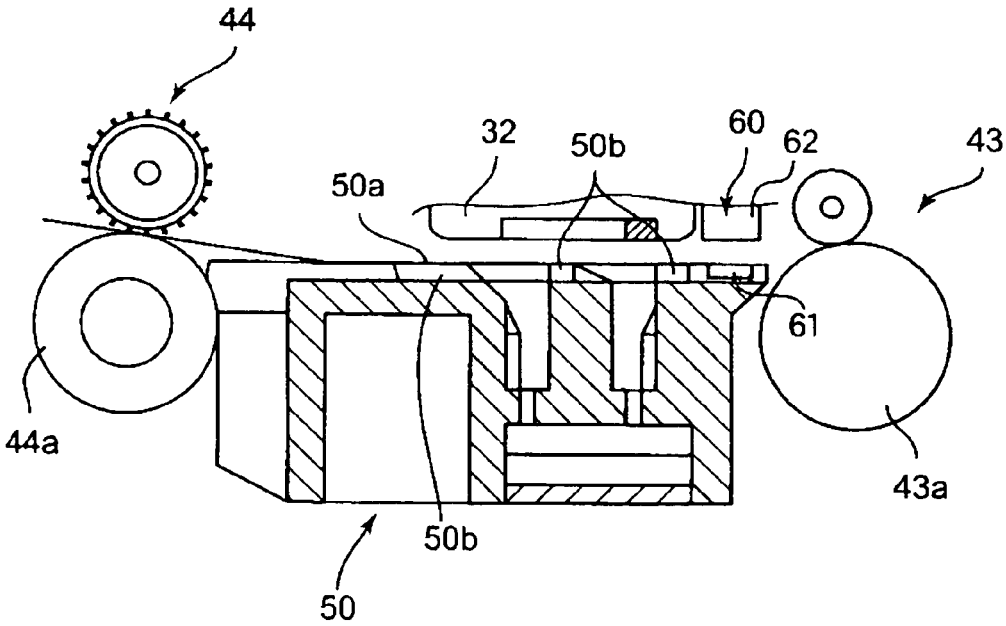

Also, as shown in FIG. 3 etc., the carriage 30 is provided facing a platen 50. As shown in FIG. 2 etc., an ink cartridge 31 of each color is removably mounted on the carriage 30. Also, a print head 32 is provided in a lower portion of the carriage 30. As shown in FIG. 4, in the print head 32, nozzles 33*a* are arrayed in lines in a transporting direction (the sub-scanning direction) of the lens sheet 12, forming a nozzle array 33 corresponding to an ink of each color. In the embodiment, the nozzle array 33 is configured of, for example, 180 nozzles 33*a*, of which a $180_{th}$ nozzle 33*a* is positioned on the paper feed side, and a first nozzle 33*a* on the paper discharge side.

Also, in the nozzle array 33 which, being provided in the lower portion of the carriage 30, is correlated with each ink, a piezoelectric element (not shown) is disposed for each nozzle 33*a*. An operation of the piezoelectric element makes it possible to eject ink droplets from a nozzle 33*a* located at an end of an ink passage. The print head 32 not being limited to a piezoelectric drive type using the piezoelectric element, it is acceptable to use other types. As major ones of the other types, it is possible to propose, for example, a heater type utilizing a force of bubbles generated by heating ink by means of a heater, a magnetostrictive type using a magnetostrictive element, an electrostatic type utilizing an electrostatic force, a mist type which controls a mist using an electric field, and the like.

Also, as shown in FIG. 3 etc., the printer 10 includes the paper transporting mechanism 40. The paper transporting mechanism 40 includes the PF motor 41 (refer to FIG. 2) for transporting the lens sheet 12 etc., and a paper feed roller 42 compatible with a feeding of plain paper etc. Also, a PF roller pair 43 for transporting and/or nipping the lens sheet 12 is provided closer to the paper discharge side than the paper feed roller 42. A drive power from the PF motor 41 is transmitted to, of the PF roller pair 43, a PF drive roller 43*a*, enabling a step-by-step transporting of the lens sheet 12.

Also, the platen 50 and the heretofore described print head 32 are disposed on the paper discharge side of the PF roller pair 43 in such a way that they vertically face each other. The platen 50 supports, from below, the lens sheet 12 transported underneath the print head 32 by the PF roller pair 43. Also, a paper discharge roller pair 44 similar to the heretofore described PF roller pair 43 is provided closer to the paper discharge side than the platen 50. The drive power from the PF motor 41 is transmitted to a paper discharge drive roller 44*a* of the paper discharge roller pair 44, as well as to the PF drive roller 43*a*.

Also, in the printer 10, an opening 45 is provided on the rear end side opposite the paper discharge side, and below the paper feed roller 42. The opening 45 is an opening portion for causing a printing subject difficult to fold, such as the lens sheet 12, to pass through it on the rear end side of the printer 10. It is acceptable that the lens sheet 12, apart from passing alone through the opening 45, passes through it while being placed on a tray or the like.

Figure 6:
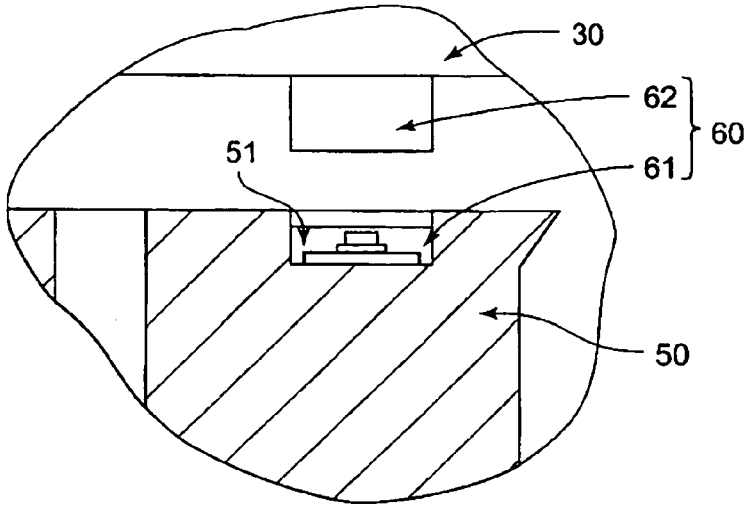
FIG. 6 is a sectional side view showing a shape in a vicinity of a platen.

As shown in FIGS. 1 and 6, a lens detection sensor 60 which, corresponding to lens detection means, detects the lens pitch (a lens resolution) of the convex lenses 12A1 in the lens sheet 12 is disposed in a portion between a lower surface of the carriage 30 and the platen 50. The lens detection sensor 60, being a light emitting/receiving type (transmissive) sensor, as shown in FIG. 1 and FIG. 6 etc., includes a light emitter 61 and a light receiver 62. Of these, the light emitter 61 is provided on a side closer to the platen 50 (a lower side) than the transported lens sheet 12. Also, the light receiver 62 is provided on a side closer to the carriage 30 (a higher side) than the transported lens sheet 12.

As shown in FIG. 1, the light emitter 61 of the embodiment, employing a direct-light type configuration in which light sources 612 are disposed on a side opposite a light emergence side, includes a collection of light sources 611 and a diffuser plate 613 covering the collection of light sources 611. The light emitter 61 is provided on the rear end side of the platen 50 (the paper feed side of the lens sheet 12). A portion in which the light emitter 61 is provided not being limited to the platen 50, it is acceptable that it is provided in another fixed portion, and it is also acceptable that it is provided on the front end side of the platen 50. In this way, by providing the light emitter 61 on the rear end side of the platen 50, the light emitter 61 and the light receiver 62, to be described hereafter, face each other.

Also, the light emitter 61 is in a recess 51 existing on the rear end side of the platen 50. The recess 51 is a portion depressed downward with respect to the other portion of the platen 50. The recess 51 is provided having a fixed depth dimension or larger in such a way that the collection of light sources 611 (the light sources 612) can be spaced a fixed distance away from the diffuser plate 613.

Also, as shown in FIG. 1, the collection of light sources 611 has a large number of the light sources 612 arrayed in the main scanning direction. The light sources 612 are LEDs (light emitting diodes) which emit light of a prescribed color As the LEDs, there are some which emit lights of various wavelengths such as visible light or infrared light but, from a viewpoint of being unlikely to shine too brightly in the eye of a user, it is desirable to use infrared LEDs which emit the infrared light. Also, the light sources 612, as well as being disposed at intervals of a prescribed space, in consideration of a directivity of the light sources 612, are spaced a fixed distance away from the lens sheet 12. By that means, the light emitted from the light sources 612 is radiated to the diffuser plate 613 in such a way as to have a slight spread. Also, the diffuser plate 613 makes various changes to a traveling direction of the light emitted from the light sources 612. By that means, the light passing through the diffuser plate 613, being equalized in contrast, is caused to emerge toward the lens sheet 12.

In the embodiment, the collection of light sources 611 having the light sources 612 arrayed is provided in such a way as to be larger than a prescribed width of the lens sheet 12. For that reason, the collection of light sources 611 is provided in such a way that a large difference in contrast will not occur in the light made incident on the lens sheet 12. Also, in a case of desiring to further reduce the contrast of the light, it is acceptable, by changing the disposition of the light sources 612 configuring the collection of light sources 611, to stagger the large number of light sources 612. Also, it is also acceptable to employ a configuration in which the heretofore described diffuser plate 613 is omitted.

Also, the light receiver 62 is provided on the lower surface of the carriage 30. The light receiver 62 is attached to the lower surface of the carriage 30 and, in addition, is attached to, for example, a portion spaced away from a home position in the main scanning direction, and to the paper feed side in the sub-scanning direction. However, the attachment position of the light receiver 62 not being limited to such a portion, it is acceptable to have a configuration in which the light receiver 62 is attached to, for example, a central portion in the main scanning direction on the lower surface of the carriage 30.

In the embodiment, the light receiver 62 includes a substrate 621, a light receiving element 623 and a slit plate 624. Of these, the substrate 621, being a portion to which the light emitting element 623 is attached, includes a housing 622 to which the light emitting element 623 is attached. The housing 622 is surrounded by a plate-shaped member. Also, the light receiving element 623 is attached to the housing 622 surrounded by the plate-shaped member, and only a lower surface side is opened. By that means, a configuration is such as to prevent a receiving of a fixed diffusion light.

Also, the light receiving element 623 is an element which can convert received light into an electrical signal, such as, for example, a phototransistor, a photodiode or a photo-IC. Also, the slit plate 624 is attached to the lower surface side of the housing 622. A slit 624*a* which allows the light to pass through is formed in the slit plate 624, a configuration being such as to allow a receiving of light in a prescribed direction (in FIG. 1, light in a direction along an optical axis L) via the slit 624*a*.

It is desirable that a width dimension of the slit 624*a* is equal to or less than ½ a lens width of the convex lenses 12A1. However, in the event that the width dimension of the slit 624*a* is too small, a gap between the platen 50 and the carriage 30 becoming difficult to adjust, there is a possibility that an efficient detection cannot be carried out. For this reason, it is necessary to set the width dimension of the slit 624*a* at a fixed dimension value or greater. Also, in the slit plate 624, light radiated to a portion other than the slit 624*a* is shut off by the slit plate 624. With such a configuration, diffusion light other than the light in the direction along the optical axis L is prevented from being received by the light receiving element 623.

Also, it is acceptable to employ a configuration in which the heretofore described slit plate 624 is not provided. In this case, although a lens resolution detection accuracy of the light receiving element 623 deteriorates, the detection of the lens resolution of the lens sheet 12 is enabled by a focal action etc. of each convex lens 12A1.

Also, in the embodiment, although the light receiver 62 does not make contact with the lens sheet 12 while the lens sheet 12 is being transported, it is disposed in proximity to the lens sheet 12 in such a way as not to worsen a transportability. By that means, the light emitted from the light emitter 61 diffuses with a curvature center of each convex lens 1 2A1 in the interface Q as a focal point, but falls incident on the light receiver 62 in a condition in which the light does not diffuse very widely.

In a case in which the light emitter 61 employs the direct-light type, a configuration thereof is not limited to one in which a large number of light emitting diodes are arrayed, and it is acceptable to use a linear light source longitudinal in the main scanning direction. As the linear light source, specifically, it is possible to use a CFL (Cathode Fluorescent Lamp), a CCFL (Cold Cathode Fluorescent Lamp) or an EL (Electro Luminescence). It is also acceptable that the light emitter 61 uses, apart from them, a laser oscillator, a lamp or the like which can generate a laser beam such as visible light or infrared light.

Also, as the light emitter, instead of employing the direct-light type, it is acceptable to employ an edge-light type configuration. In this case, the light emitter comes to include a light source disposed at an end in the main scanning direction, a reflector which reflects light from the light source toward a side in the main scanning direction, a light guide plate which, as well as the light traveling through, is longitudinal in the main scanning direction, reflecting members which, being attached to a lower surface side and a side surface side of the light guide plate and to the other end side of the light guide plate in the longitudinal direction, reflect the light, a diffusing film which diffuses the light emitted toward an upper surface side, and reflective dots which, being disposed on the lower surface of the light guide plate, diffuse the light.

Figure 7:
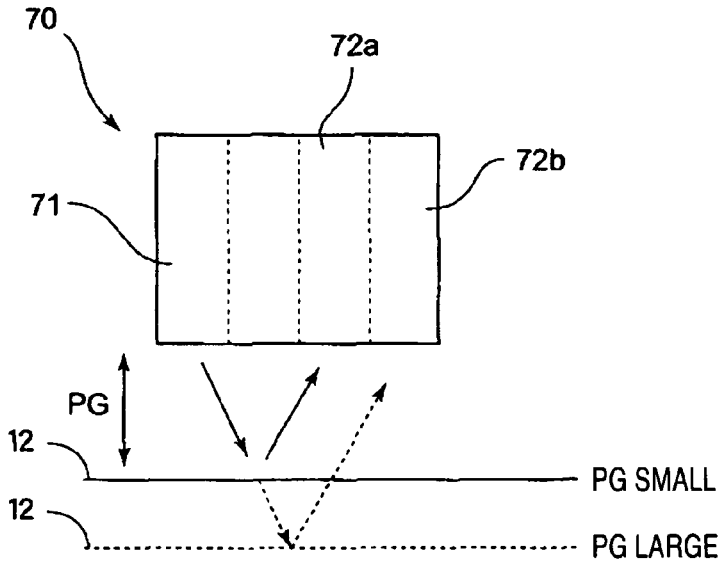
FIG. 7 is a schematic diagram showing a configuration of a gap sensor.

Also, in order to measure a distance PG between the lens sheet 12 and the nozzles 33*a*, it is preferable that a gap detection sensor 70, apart from the lens detection sensor 60, exists on the lower surface of the carriage 30. FIG. 7 is an illustration of the gap detection sensor 70 which detects the distance PG. As shown in FIG. 7, the gap detection sensor 70 includes a light emitter 71 and two light receivers (a first light receiver 72*a* and a second light receiver 72*b*). The light emitter 71, including a light emitting diode, radiates light to the lens sheet 12. Each of the first light receiver 72*a* and the second light receiver 72*b*includes a light receiving element which transmits an electrical signal corresponding to a quantity of light received. The second light receiver 72*b* is provided in a position farther away from the light emitter 71 than the first light receiver 72*a*.

The light emitted from the light emitter 71, as well as being radiated to the lens sheet 12, is reflected thereby. The reflected light is made incident on the heretofore described light receiving element, and is converted into the electrical signal corresponding to the quantity of light incident on the light receiving element. At this point, in the event that the distance PG is small, the light reflected by the lens sheet 12 is made incident mainly on the first light receiver 72*a*, but only the diffusion light is made incident on the second light receiver 72*b*. Consequently, an output signal from the first light receiver 72*a*becomes larger than an output signal from the second light receiver 72*b*.

Meanwhile, in the event that the distance PG is large, the reflected light is made incident mainly on the second light receiver 72*b*, and only the diffusion light is made incident on the first light receiver 72*b*. Consequently, the output signal from the second light receiver 72*b* becomes larger than the output signal from the first light receiver 72*a*. For this reason, in the event that a relationship between a ratio of the output signal from the first light receiver 72*a* to the output signal from the second light receiver 72*b* and the distance PG is obtained in advance, it is possible, based on the ratio of the output signals, to detect the distance PG corresponding to the lens sheet 12 or the like. In this case, it is preferable to store information on the relationship between the ratio of the output signals from the light receivers 72*a* and 72*b* and the distance PG, as a table, in an ROM 102 or a nonvolatile memory 104.

This kind of detection of the output signals is carried out while the carriage 30 is being driven in the main scanning direction. At the time of this drive, by correlating the detection with a position detection by the linear encoder 80 to be described hereafter, it is possible to detect the distance PG of the lens sheet 12 in the main scanning direction.

The gap detection sensor 70 can be combined with the heretofore described lens detection sensor 60. In this case, the gap detection sensor 70 and the lens detection sensor 60 are disposed in such a way that an optical axis of the light emitter 61 slants and, in the event that it is arranged that the ratio between the output signals from the first light receiver 72*a* and the second light receiver 72*b* varies according to the distance PG, it is possible to combine the gap detection sensor 70 and the lens detection sensor 60.

Also, as shown in FIG. 2 etc., the linear encoder 80 corresponding to encoder signal output means is provided in the carriage mechanism 20. The linear encoder 80 includes the scale 81, on which a line pattern formed of a black printing portion and a transparent portion which transmits light is repeated, and a linear sensor 82 which, as well as outputting light toward the scale 81, converts the light reflected off the scale 81 into an electrical signal (an encoder signal; hereafter, referred to as an ENC signal) and transmits it to the controller 100.

Figure 8:
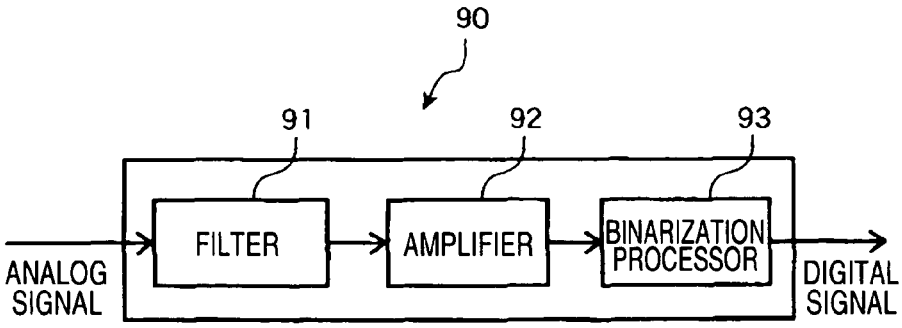
FIG. 8 is a block diagram showing a configuration of a signal output unit.
Figure 9:
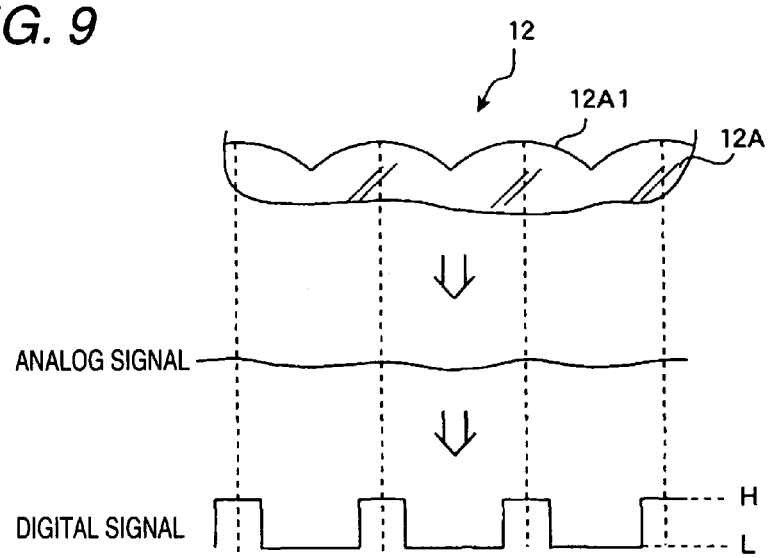
FIG. 9 is a diagram showing an analog signal and a digital signal in a lens pitch detection.

Next, a description will be given of a configuration of a signal formation unit 90. As shown in FIG. 8, the signal formation unit 90 includes a filter 91, an amplifier (AMP) 92 and a binarization processor 93. Of these, the filter 91 is connected to one end side of a signal line 94. The other end side of the signal line 94 is connected to the heretofore described light receiver 62 (the light receiving element 623). For this reason, an analog signal occurring in the light receiver 62 is transmitted to the filter 91 via the signal line 94 but, in the filter 91, a frequency component other than a prescribed band is removed from the analog signal (refer to FIG. 9). By that means, a digital signal (a lens signal) such as that shown in FIG. 9 is generated.

Also, the signal passing through the filter 91 is inputted into the AMP 92 and amplified to a prescribed voltage etc. (as an example, 40 times). The thus amplified signal is inputted into the binarization processor 93 and, depending on whether or not the inputted signal exceeds a threshold, it is set as a binary signal (a binarized signal) of an H level or an L level. In this condition, the binarized signal is inputted into the controller 100 to be described hereafter and, by detecting a switching timing of the H level signal and/or the L level signal, it is possible to measure the lens resolution of the lens sheet 12.

Also, as shown in FIG. 2, the printer 10 includes an interface 171. The printer 10 is connected to a computer 170 via the interface 171. Also, the printer 10 includes a rotary encoder 172. The rotary encoder 172 includes a rotary sensor 172*b* similar to the heretofore described linear sensor 82. However, unlike the heretofore described linear encoder 80, the rotary encoder 172 has a code plate 132*a* provided in a disk shape. The other configurations of the rotary encoder 172 are similar to those of the linear encoder 80.

<Details of Controller of Printer>

Next, a description will be given of the controller 100. The controller 100, being a portion which, carrying out various controls, corresponds to broadly-defined control means, receives an output signal from each of a not-shown PW sensor for detecting a paper width, the lens detection sensor 60, the gap detection sensor 70, the linear sensor 82, the rotary encoder 172 to be described hereafter, a power switch which turns a power of the printer 10 on or off, and the like. As shown in FIG. 2, the controller 100 includes a CPU 101, the ROM 102 storing various programs, an RAM 103 temporarily storing data, the nonvolatile memory (PROM) 104, an ASIC 105, a head driver 106 and the like, and they are connected via a bus 107. Then, in conjunction with these or by adding a circuit which carries out a specific process and so on, a configuration (a pseudo ENC signal output mechanism 110) shown in the block diagram of FIG. 10 is realized.

Figure 10:
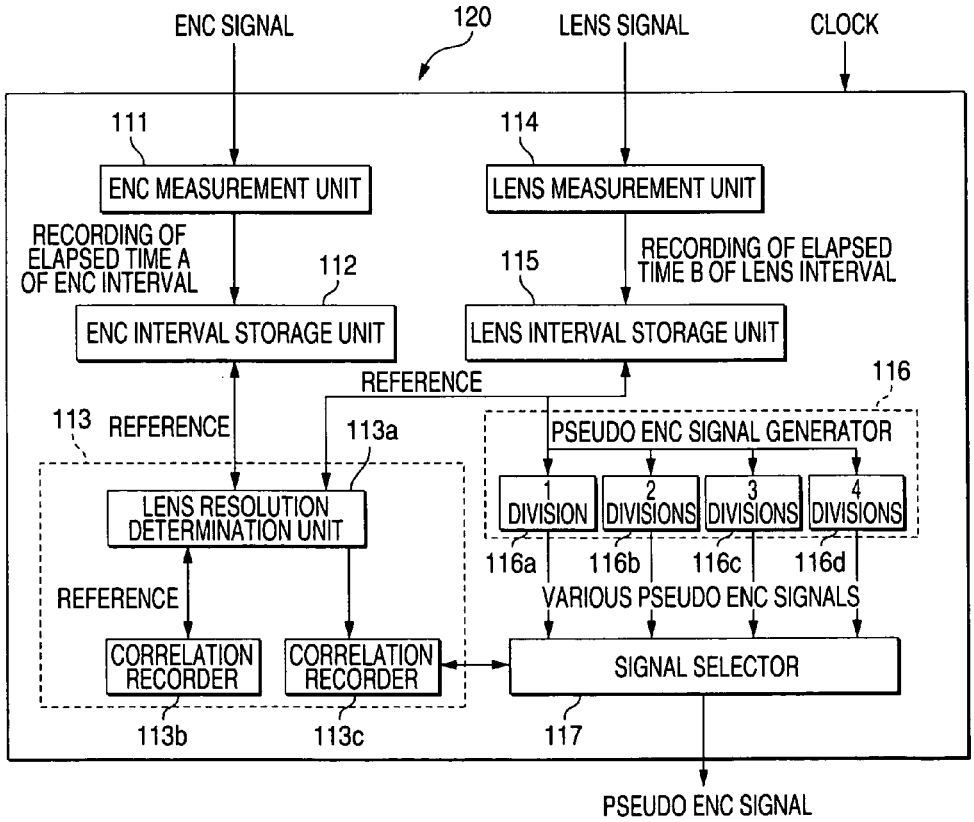
FIG. 10 is a diagram showing an outline configuration of a pseudo ENC signal output mechanism.

It is acceptable that such a configuration of the pseudo ENC signal output mechanism 110 shown in FIG. 10 is realized as hardware, and it is also acceptable that it is realized as software. Also, hereafter, when describing each configuration of the pseudo ENC signal output mechanism, a description will also be given of a function and an operation performed by each configuration.

As shown in FIG. 10, the pseudo ENC signal output mechanism 110 includes an ENC measurement unit 111, an ENC interval storage unit 112, a normalization processor 113, a lens measurement unit 114, a lens interval storage unit 115, a pseudo ENC signal generator 116 and a signal selector 117.

Of these, the ENC measurement unit 111, in order to measure an ENC signal interval, counts a number of clock signals (a number of clocks) between positive edges (timings at which the L level signal switches to the H level signal; corresponding to rising edges) of the input ENC signal. The ENC measurement unit 111 corresponds to encoder signal counting means. Also, the number of clocks counted corresponds to an elapsed time A (equivalent to second elapsed time information). Herein, the clock signal has a cycle of, for example, 14.4 KHz. The cycle of the clock signal has a predominantly shorter time than a cycle of the ENC signal. Also, the clock signal is generated by, for example, a CPU timer furnished on the CPU 101, a frequency generator circuit or the like.

Also, the ENC interval storage unit 112 is a portion which stores information on the elapsed time A (the number of clocks) calculated by the heretofore described ENC measurement unit 111. Every time a positive edge of the ENC signal is detected, the information on the elapsed time A (the number of clocks) is stored in the ENC interval storage unit 112. The stored information on the elapsed time A is outputted to a lens resolution determination unit 113*a* in accordance with an acquisition request from the lens resolution determination unit 113*a*.

It is preferable that a plurality of storage areas (buffers) is provided in the ENC interval storage unit 112, and that the information is stored in each storage area by an FIFO (First In First Out) method. In the case of providing the plurality of storage areas in the ENC interval storage unit 112, in accordance with a request to acquire information from the lens resolution determination unit 113*a*to be described hereafter or the like, the information on the elapsed time A is read by the FIFO method. In that case, the read information on the elapsed time A is deleted from a storage area in which the relevant information is stored.

Also, the normalization processor 113 includes therein the lens resolution determination unit 113*a*, a correlation recorder 113*b* and a result recorder 113*c*.

Of these, the lens resolution determination unit 113*a* corresponds to score calculation means and search means. Also, the lens resolution determination unit 113*a* receives the information on the elapsed time A (the number of clocks) stored in the ENC interval storage unit 112 and information on an elapsed time B (equivalent to first elapsed time information) (a number of clocks) stored in the lens interval storage unit 115. Then, a normalization is carried out based on the received information on the elapsed time A and the elapsed time B. As used herein, the normalization refers to a division of the elapsed time A by the elapsed time B. That is, score=elapsed time A /elapsed time B. By the normalization, the score to be described hereafter is calculated.

Also, after the score to be described hereafter is calculated, the lens resolution determination unit 113*a* searches for a score identical to the calculated one from the table shown in FIG. 11 (corresponding to a first table). Then, as a result of the searching, in the event that there is the identical score, a correlation value correlated with the score is stored in the result recorder 113*c*. Also, in the event that there is no correlation value correlated with the score, a value to be stored in the result recorder 113*c* is set at 0, or a correlation value proximate to the score is stored. In the table in FIG. 11, the correlation value is a lens resolution (LPI).

Herein, as long as the carriage 30 exists over the lens sheet 12, any timing is acceptable in order to acquire the heretofore described information on the elapsed time B. However, it is desirable that the information on the elapsed time B is acquired at a second convex lens 12A1 from an edge of the lens sheet 12. At a first convex lens 12A1, which has a lens signal at a sheet edge of the lens sheet 12, a situation occurs in which an H level signal interval is shorter than in the other portions, and so on. Also, a case can also be considered in which a value of N is set to become larger at an $N^{th}$ convex lens 12A1. However, in the event that the value of N is set to be too large, a situation occurs in which, although the nozzles 33*a* have approached a top of the lens sheet 12, the lens detection sensor 60 has not reached the $N^{th}$ convex lens 12A1 for identifying the lens resolution. For that reason, as described heretofore, it is preferable that the timing to acquire the information on the elapsed time B is set at the second convex lens 12A1.

In the event that a valley is reliably provided at the edge of the lens sheet 12, it is acceptable that the timing to acquire the information on the elapsed time B is set at the first convex lens 12A1. Also, in the heretofore described lens sheet 12, as a plurality of the convex lenses 12A1 can be detected by the time ink droplets are actually ejected from a portion in which a convex lens 12A1 is first detected, it is possible to carry out a real-time printing after the detection.

Also, the correlation recorder 113*b* is a portion storing a table such as that shown in FIG. 11. A score calculated by the normalization and information on a lens resolution correlated with the score (equivalent to the correlation value; LPI in FIG. 11) exist in the table.

Herein, the elapsed time A corresponds to a time taken for the light receiver 62 to pass through one pattern on the scale 81. For that reason, as well as the elapsed time A increasing (the number of clocks increasing) in the event that a distance between the line patterns is long, the elapsed time A decreases (the number of clocks decreases) in the event that the distance between the line patterns is short. Also, the elapsed time B corresponds to a time taken for the light receiver 62 to pass through one convex lens 12A1. A description will be given of these, by exemplifying cases in which, as well as the elapsed time A corresponding to 180 dpi, the score is 1.0 and 3.0. Firstly, in the case of a score of 1.0, from 1.0=elapsed time B/elapsed time A, a lens resolution corresponding to the elapsed time B is obtained as 180 lpi. Also, in the case of a score of 3.0, from 3.0=elapsed time B/elapsed time A, a lens resolution lpi corresponding to the elapsed time B is obtained as 60 lpi.

Also, the result recorder 113*c* is a portion which stores the correlation value determined (found) by the heretofore described lens resolution determination unit 113*a*. Herein, in the event that a correlation value correlated with the score determined by the lens resolution determination unit 113*a* exists, the correlation value is stored in the lens resolution determination unit 113*a*. However, in the event that no correlation value correlated with the heretofore described score exists, a value to be stored is set at 0, or a correlation value proximate to the score is stored.

Also, the lens measurement unit 114 measures an interval of a lens signal outputted from the binarization processor 93. The lens measurement unit 114 corresponds to lens signal counting means. As in the ENC measurement unit 111, the lens measurement unit 114 also counts a number of clock signals (a number of clocks) between positive edges (timings at which the L level signal switches to the H level signal; corresponding to rising edges) of the input lens signal. The number of clocks counted corresponds to the elapsed time B.

Also, the lens interval storage unit 115 is a portion which stores the information on the elapsed time B (the number of clocks) calculated by the heretofore described lens measurement unit 114. Every time a positive edge of the lens signal is detected, the information on the elapsed time B (the number of clocks) is stored in the lens interval storage unit 115. The stored information on the elapsed time B is outputted to the lens resolution determination unit 113*a*in accordance with the acquisition request from the lens resolution determination unit 113*a*. Also, in accordance with an acquisition request from the pseudo ENC signal generator 116, the information on the elapsed time B stored in the lens interval storage unit 115 is outputted to the relevant pseudo ENC signal generator 116.

It is preferable that the lens interval storage unit 115 is also provided with a plurality of storage areas (buffers), and that the information is stored in each storage area by the FIFO (First In First Out) method. Also, in this case too, in the case of providing the plurality of storage areas in the lens interval storage unit 115, in accordance with the request to acquire information from the lens resolution determination unit 113*a* or the pseudo ENC signal generator 116, the information on the elapsed time B is read by the FIFO method. In that case, the read information on the elapsed time B is deleted from a storage area in which the relevant information is stored.

In the case of the deletion by the FIFO method, for example, in the event that, immediately after the information on the elapsed time B is referred to in the lens resolution determination unit 113*a*, the relevant information on the elapsed time B is deleted, a problem occurs in that it cannot be referred to in the lens interval storage unit 115. For this reason, it is necessary to carry out a control in such a way that, after the information on the elapsed time B is referred to in all portions (in FIG. 10, the lens resolution determination unit 113*a* and the lens interval storage unit 115) in which the information needs to be referred to, the information on the elapsed time B is deleted by the FIFO method.

At this point, in the event that such a control carried out at the time of the deletion as the abovementioned (a buffer management) becomes complicated and so on, it is acceptable to provide the same number of buffers (storage areas) as a number of portions controlled (portions in which the information is referred to; in the heretofore described case, the lens resolution determination unit 113*a*and the lens interval storage unit 115). In this case, there is no efficiency in terms of a memory source. However, when the referring is completed in each portion controlled, it is sufficient to only execute the deletion by the FIFO method, simplifying the control carried out at the time of the deletion.

Also, the pseudo ENC signal generator 116 reads the information on the elapsed time B stored in the lens interval storage unit 115. Then, based on the information on the elapsed time B, it generates a pseudo ENC signal (corresponding to a divided lens signal) which is divided into various numbers of divisions (of which a frequency is changed). At this point, in the embodiment, the pseudo ENC signal generator 116 is provided with a 1-division processor 116*a*, a 2-division processor 116*b*, a 3-division processor 116*c* and a 4-division processor 116*d*. As in the heretofore described lens measurement unit 114 and the like, the 1-division processor 116*a* to the 4-division processor 116*d* count the clock signals. That is, a counter function exists also in the 1-division processor 116*a* to the 4-division processor 116*d*.

The pseudo ENC signal generator 116 corresponds to lens signal division means. Also, the 1-division processor 116*a* to the 4-division processor 116*d* correspond to a signal division processor.

Also, the pseudo ENC signal is formed, specifically, by switching between the H level and L level at intervals which can be obtained from an expression; elapsed time B / (number of divisions × 2). Suppose, for example, that there is a case in which a number of clocks equivalent to the elapsed time B of the lens interval is 10000, and a pseudo ENC signal selected by the signal selector 117 to be described hereafter selects a pseudo ENC signal formed by the 3-division processor 116*c*. In this case, an interval of signal switching between the H level and the L level is obtained as 10000/3×2)=1666. For that reason, the H level signal is outputted when the count value of the number of clocks falls in a range of 0 to 1665, the L level signal when in a range of 1666 to 3331, the H level signal when in a range of 3332 to 4997, the signal L level when in a range of 4998 to 6663, the H level signal when in a range of 6664 to 8329, and the L level signal when in a range of 8330 or more.

Also, the 1-division processor 116*a* to the 4-division processor 116*d*, when finishing a signal generating process for a length of the elapsed time B corresponding to a certain convex lens 12A1, subsequently, carry out a signal generating process for a length of the elapsed time B corresponding to the next convex lens 12A1. For that reason, as described heretofore, the information on the elapsed time B is stored in the lens interval storage unit 115 by the FIFO method. For that reason, the 1-division processor 116*a* to the 4-division processor 116*d*, when finishing a process for a length of a certain elapsed time B, read an elapsed time B corresponding to a next processing order of the FIFO method. Also, when the 1-division processor 116*a* to the 4-division processor 116*d* receive information on a new elapsed time B, the count value in each of the 1-division processor 116*a* to the 4-division processor 116*d* is cleared to zero.

Also, the generation of the pseudo ENC signal is carried out simultaneously in each of the 1-division processor 116*a*, the 2-division processor 116*b*, the 3-division processor 116*c* and the 4-division processor 116*d*. In the heretofore described embodiment, the pseudo ENC signal generator 116 includes the four division processors, the 1-division processor 116*a* to the 4-division processor 116*d*. However, the number of division processors and the number of divisions are not limited to the 1-division processor 116*a* to the 4-division processor 116*d*, and it is possible to divide it into various numbers of divisions.

Also, the pseudo ENC signal outputted from the pseudo ENC signal generator 116 is inputted into the signal selector 117. The signal selector 117 reads a correlation value stored in the result recorder 113*c*. Then, based on the correlation value, it selects a pseudo ENC signal to be outputted. In the table in FIG. 11, the correlation value is designated as LPI. For that reason, in the signal selector 117, it is acceptable, in the event that the read LPI fulfills a certain conditional expression, to select and output a pseudo ENC signal corresponding to the conditional expression. For example, the conditional expression may be 180/1.5<LPI in the case of one division, 180/2.5<LPI≦180/1.5 in the case of two divisions, 180/3.5<LPI≦180/2.5 in the case of three divisions, LPI≦180/3.5 in the case of four divisions, and so on.

At this point, in the signal selector 117, instead of selecting a pseudo ENC signal in accordance with the conditional expression as described heretofore, it is acceptable to have a table in which the number of divisions is correlated with LPI and, based on the number of divisions, select a pseudo ENC signal. This case is shown in FIG. 12.

In the table shown in FIG. 12 (corresponding to a second table), the correlation value is indicated by the number of divisions. In this case, a condition is such that a number of divisions is searched for in the lens resolution determination unit 113*a*, and the number of divisions is stored in the result recorder 113*c*. For that reason, the signal selector 117 carries out a control in such a way as to, when reading a number of divisions stored in the result recorder 113*c*, output only a pseudo ENC signal corresponding to the number of divisions. In this case, it is possible to speed up a signal selection process.

In the event that the number of divisions stored in the result recorder 113*c* does not correspond to any of the 1-division processor 116*a* to the 4-division processor 116*d*, for example, the 1-division processor 116*a* is selected. However, it is acceptable to select another division processor.

Figure 13:
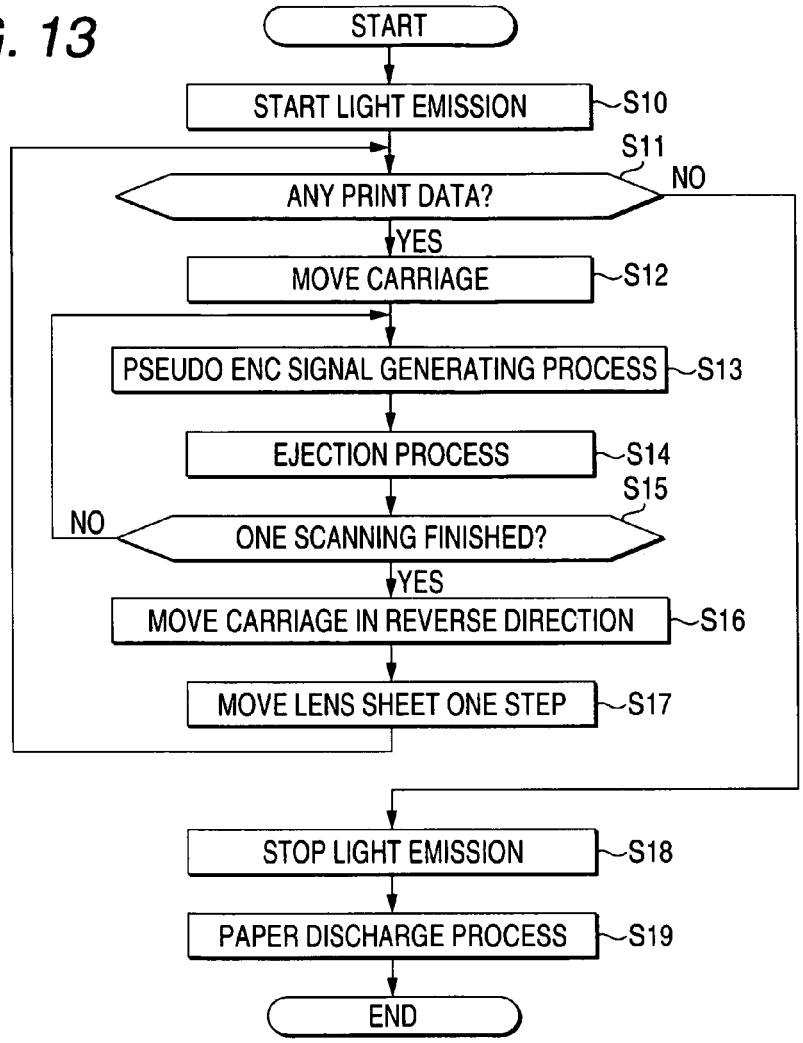
FIG. 13 shows a whole of a process flow of executing a printing on a lens sheet.

Using the above configuration, a description will hereafter be given, based on a flow in FIG. 13, of details of a case in which the printer 10 is operated.

<Whole of Operation>

FIG. 13 illustrates an operation flow from a light emission start to a paper discharge in the printer 10.

In the printer 10, the CPU 101 causes a start of a light emission of the light emitter 61 (S10). At this time, an operation of the binarization processor 93 is also started. To continue, the CPU 101 inquires of the computer 170 whether or not print data exists (S11). If the print data exists, the CPU 101 moves to S12 and, otherwise, it moves to S18.

To continue, if the print data exists, print data for one line is received from the computer 170, and a printing operation is started. That is, the carriage 31 starts a reciprocating operation in the main scanning direction (S12).

Also, in a case in which the carriage 31 moves, the linear sensor 82 generates an ENC signal. Along with this, the binarization processor 93 generates a lens signal. Then, based on the ENC signal and the lens signal, a process of generating a pseudo ENC signal is carried out (S13). Also, after the creation of the pseudo ENC signal, an ejection controller (refer to an ejection controller 130 to be described hereafter), by multiplying a corrected lens signal by a prescribed number of times, creates a timing signal PTS. In addition, the ejection controller, based on the timing signal PTS and the print data, controls and drives the print head 32. By that means, an ejection process is carried out in which ink droplets are ejected from each nozzle 33*a* (S14). By such an ejection of ink droplets, a desired image is printed on the lens sheet 12.

Next, the CPU 101 determines whether or not a printing process for one scan is finished (S15). If it is determined in S15 that it is finished, the CPU 101 moves to S16 and, otherwise, it returns to S13 and repeats the same process.

Meanwhile, the light receiver 62 is disposed in an upper right portion in FIG. 4 on the lower surface of the carriage 31. Consequently, in a case in which the carriage 31 scans in a direction away from the home position, as the light receiver 62 precedes the print head 32, the heretofore described operation becomes possible. On the contrary, in a case in which the carriage 31 scans in a direction toward the home position, as the light receiver 62 follows the print head 32, the heretofore described operation is impossible. Thereupon, for example, in the case in which the carriage 31 scans in the direction toward the home position, it is arranged to only move the carriage 31 and to carry out no printing (S16).

In this way, when the printing operation for one line is completed, the CPU 101 drives the PF motor 41, and moves the lens sheet 12 in the sub-scanning direction by an amount equivalent to one step (S17). Then, the CPU 101 returns to S11 and repeats the same process. That is, the CPU 101, based on print data for the next one line, executes a process of printing the print data by the same process as in the heretofore described case. By repeating this kind of process, it is possible to print the desired image on the lens sheet 12.

Also, if a NO judgment is made in S11, the CPU 101 moves to S18 and, if the light emitter 61 is in a condition of light emission, stops the light emission of the light emitter 61 (S18). Furthermore, the CPU 101 drives the PF motor 41 and executes a process of discharging the lens sheet 12 (S19). As a result, the lens sheet 12 for which the printing is completed is discharged to an exterior of the printer 10.

<Outline of Generation of Pseudo ENC Signal>

Figure 14:
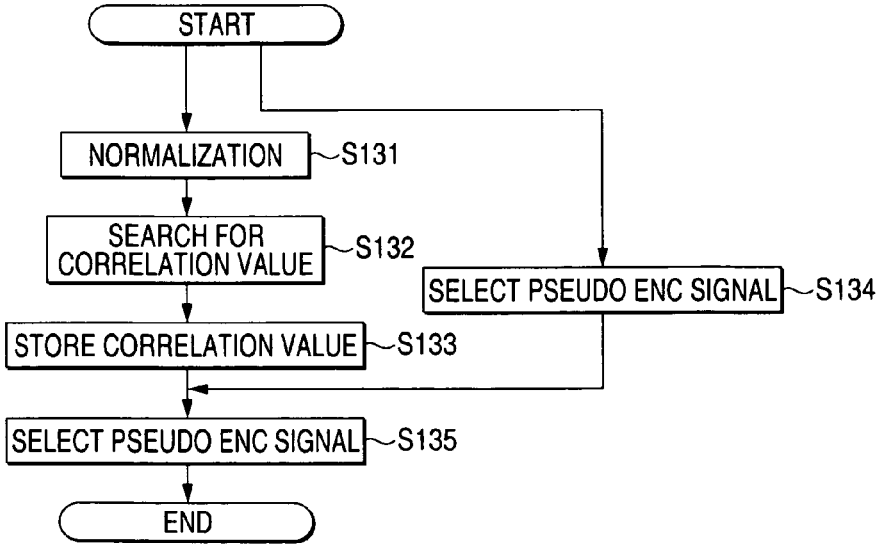
FIG. 14 shows an outline of a process flow by the pseudo ENC signal output mechanism.

Next, it is a figure showing an outline of a process flow when generating the pseudo ENC signal. FIG. 14 shows an outline of a process flow when generating the pseudo ENC signal. In the description of the configuration in FIG. 10, a description has already been given of the outline of the operation. For that reason, a description of the subsequent process flow being simplified, a description will be given of a process outline.

As shown in FIG. 14, firstly, based on the heretofore described information on the elapsed time A and information on the elapsed time B, the normalization is carried out (S131). Details of the normalization are as described heretofore.

To continue, a searching for a correlation value (in FIG. 11, LPI) is carried out based on the score obtained by the normalization (S132). To continue, the obtained correlation value is stored in the result recorder 113*c* (S133).

Also, the pseudo ENC signal generator 116, based on the information on the elapsed time B stored in the lens interval storage unit 115, carries out a division process which divides the lens signal into a prescribed number of divisions (in FIG. 10, the number of divisions is 1 to 4), and generates the pseudo ENC signal (to be precise, a candidate to be outputted as the pseudo ENC signal) (S134). Although the pseudo ENC generating process is carried out independently of S131 to S133, it is acceptable that the process of generating the pseudo ENC signal is started after any of the processes in S131 to S133.

After the processes in S133 and S134 are finished, based on the correlation value stored in the result recorder 113*c*, the signal selector 117 determines a pseudo ENC signal to be selected (S135). In the above way, one pseudo ENC signal based on the lens signal is outputted.

According to the printer 10 having this kind of configuration, it is possible to output a more finely divided pseudo ENC signal than the lens signal outputted by the lens detection sensor 60. Also, as with the lens signal, the pseudo ENC signal also reflects an actual lens resolution of the lens sheet 12. For this reason, in the event of controlling the drive of the print head 32 or the like based on the pseudo ENC signal, it is possible to print in response to the actual lens resolution, and it is possible to improve a printing accuracy. In addition, by dividing the lens signal, it is possible to realize a fine printing.

Also, in the lens resolution determination unit 113*a*, based on the elapsed time A and the elapsed time B, a score which is a ratio of them is calculated, based on which a correlation value is calculated, and a number of divisions is set based on the correlation value, determining any of pseudo ENC signals to be outputted from the 1-division processor 116*a* to the 4-division processor 116*d*. For that reason, the pseudo ENC signal to be outputted can be approximated to the ENC signal and, even though the print head 32 or the like is controlled and driven based on the relevant pseudo ENC signal, it is possible to print in a condition in which a printing property of the printer 10 on the lens sheet 12 is not significantly changed.

Furthermore, in a case of using the table shown in FIG. 11, in the event of referring to the table showing a correlation between the score and the correlation value (the lens resolution), the lens resolution is automatically determined. For that reason, it is also possible, based on the determined lens resolution, to unambiguously determine a number of divisions into which the lens signal is divided to generate the pseudo ENC signal.

Furthermore, as a lens resolution and an integer are determined simply by referring to the correlation between the score and the lens resolution, there is no more dependence on a speed or the like of the carriage 30, making it unlikely to suffer from an effect of a speed fluctuation of the carriage 30. That is, the lens detection sensor 60, which generates the lens signal, and the linear encoder 80, which generates the ENC signal, at the time of the movement of the carriage 30, synchronously generate the lens signal or the ENC signal. For that reason, in the event of calculating the score which is the ratio of them, it is possible to eliminate the effect of the speed fluctuation of the carriage 30.

Also, as the lens resolution is determined simply by calculating the score and referring to the table, there is no need to provide hardware or the like separately, and it is possible to suppress an increase in cost due to an addition of the hardware and the like. Also, as the lens resolution is automatically calculated, it eliminates a need for an operation such as the user's inputting of the lens resolution, and it is possible to improve a user-friendliness.

Also, in the case of using the table shown in FIG. 12, when the score is calculated, the correlation value (the number of divisions) is also determined. For that reason, it is possible to improve a processing speed of calculating the number of divisions. Also, as with the case of the table shown in FIG. 11, there is no more dependence on the speed or the like of the carriage 30, making it unlikely to suffer from the effect of the speed fluctuation of the carriage 30. Also, as the number of divisions is automatically calculated, it eliminates the need of an operation such as the user's inputting of the lens resolution for determining the number of divisions, and it is possible to improve the user-friendliness.

Also, in the pseudo ENC signal generator 116, it is possible, based on the lens signal, to transmit a further segmentalized divided pseudo ENC signal. At this time, the pseudo ENC signal reflects the actual lens resolution of the lens sheet 12. For this reason, in the event that the drive of the print head 32 or the like is controlled based on the pseudo ENC signal, as well as it being possible to improve the printing accuracy, it is possible to realize the fine printing.

Furthermore, in the case of generating the pseudo ENC signal, it is generated by counting a number of short-cycle clocks. For that reason, it is possible to, by dividing the lens signal into cycles of a desired size, generate the pseudo ENC signal.

Also, the lens detection sensor 60, being a transmissive sensor, is likely to be able to catch a greater quantity of light by the light receiver 62, compared with a case of using a lens detection sensor employing a reflective type, and it is possible to improve a lens resolution detectability. In addition, in the embodiment, as the light emitter 61 is provided on the platen 50, after the light is made incident on the lenticular lens 12A, it is caused to converge on the focal point of the curvature center of each convex lens 12A1 on the interface Q, and subsequently caused to emerge. For that reason, even though the light enters the lens sheet 12 from various directions, the light passing through the lens sheet 12, after being caused to converge on the focal point, becomes diffused, and it is possible to make clearer a contrast corresponding to the lens resolution, and it is possible to enhance the detection accuracy.

Second Embodiment

Figure 15:
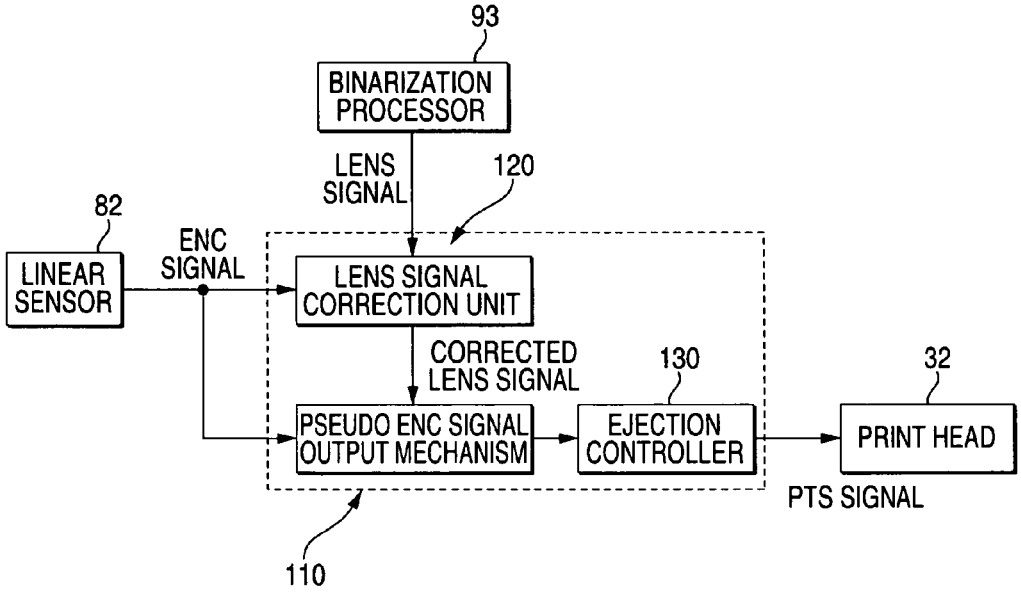
FIG. 15 a diagram showing an outline configuration including a lens signal correction unit and an ejection controller.

Hereafter, a description will be given, based on FIGS. 15 to 20, of a second embodiment of the invention. In the embodiment, as shown in FIG. 15, the lens signal input into the heretofore described pseudo ENC signal output mechanism 110, being the corrected lens signal, after being processed by the lens signal correction unit 120 (corresponding to lens signal correction means), is inputted into the pseudo ENC signal output mechanism 110. Also, the pseudo ENC signal outputted from the pseudo ENC signal output mechanism 110 is inputted into the ejection controller 130. Hereafter, a description will be given of the details.

Figure 16:
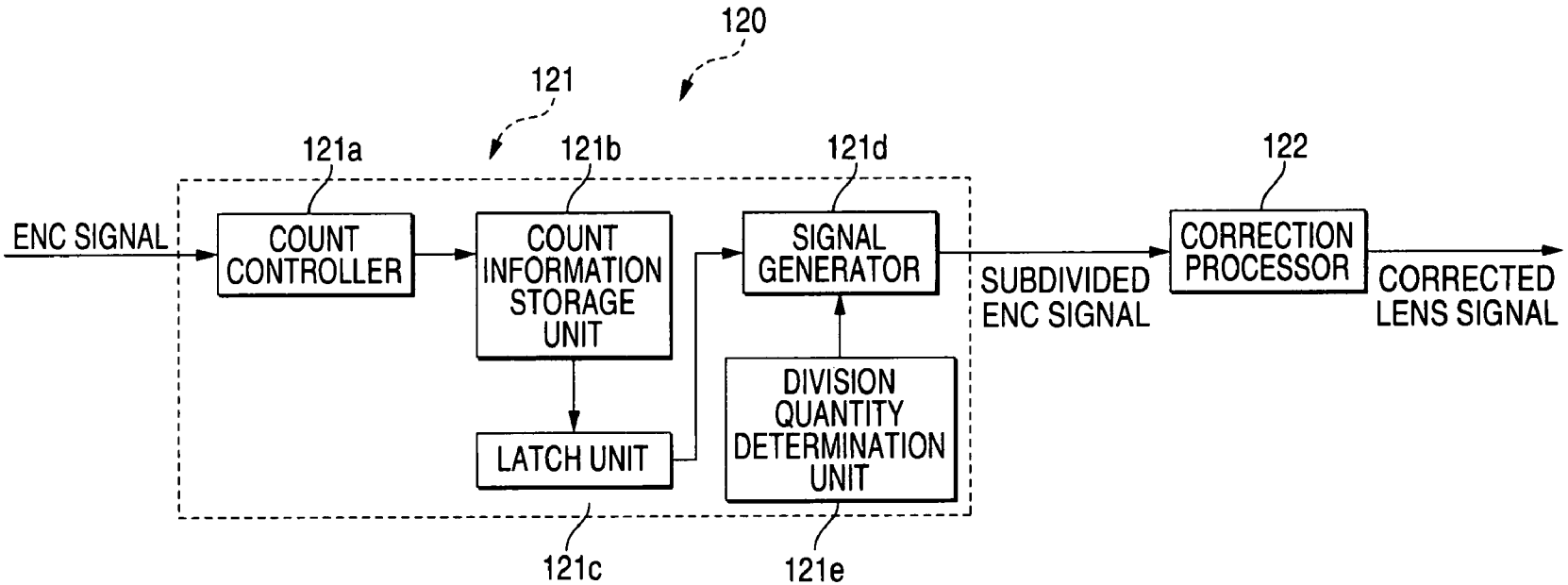
FIG. 16 is a diagram showing an outline configuration of the lens signal correction unit.

Also, as shown in FIG. 16, the lens signal correction unit 120 is provided with an ENC subdivision processor 121 and a correction processor 122. Furthermore, the ENC subdivision processor 121 is provided with a count controller 121*a*, a count information storage unit 121*b*, a latch unit 121*c*, a signal generator 121*d* and a division quantity determination unit 121*e*.

The ENC signal and the clock signal are inputted into the count controller 121*a*. The count controller 121*a*, into which the clock signal is inputted, has a function of updating a count value (a count value Ca) temporarily stored in the count information storage unit 121*b* while increasing it by +1 every time a positive edge (=a rising; the same hereafter) of the clock signal is detected. Also, in a case in which the count controller 121*a* detects a positive edge E1 (refer to FIG. 17) of the ENC signal, it carries out a control in such a way that the count value Ca in the count information storage unit 121*b* is set at zero (cleared to zero). Also, the count controller 121*a* controls the count information storage unit 121*b* and the latch unit 121*c* in such a way that, at the same time as such a zero clearance in the count information storage unit 121*b*, the count value Ca up to the time the positive edge E1 of the ENC signal is detected is copied onto the latch unit 121*c*.

Also, based on a command from the count controller 122*a*, a count value Ca corresponding to a number of positive edges in the clock signal is temporarily stored in the count information storage unit 121*b* while being increased by +1 at one time. Also, in a case in which the count information storage unit 121*b*receives an output signal corresponding to the positive edge of the ENC signal from the count controller 121*a*, as well as the count information storage unit 121*b* outputting the count value Ca temporarily stored therein to the latch unit 121*c*, it clears the count value Ca temporarily stored therein to zero. Then, again based on the command from the count controller 121*a*, it stores the count value Ca corresponding to the number of positive edges in the clock signal.

Also, the count value Ca up to the positive edge E1 of the previous time (an interval B10 in FIG. 17) is stored in the latch unit 121*c*. For this reason, the count value Ca stored in the latch unit 121*c* is a number of clock signal cycles in one cycle of the previous ENC signal. Also, the count value Ca stored in the latch unit 121*c* is outputted to the signal generator 121*d*. It is acceptable that a plurality of the count values Ca stored in the latch unit 121*c* is recordable. Also, it is acceptable to buffer the count value Ca before obtaining a division value S in the signal generator 121*d*, to be described next, and respond to an acceleration/deceleration of the carriage 30. At this point, in the case of buffering the plurality of count values Ca, a reference is made to the buffered count values Ca by the FIFO (First In First Out) method.

Also, as well as an oldest one of the count values Ca stored in the latch unit 121*c* being input into the signal generator 121*d*, the heretofore described clock signal is also inputted. The signal generator 121*d*, based on a number of divisions N set in advance in the division quantity determination unit 121*e*, divides the count value Ca and obtains the division value S. Also, the signal generator 121*d* counts a number of clock signals input. Then, the signal generator 121*d* operates in such a way as to, in the event that a count value Cb being counted has reached the set division value S, switch a signal outputted from the signal generator 121*d* between Hi and Low. By this means, a subdivided ENC signal (corresponding to a subdivided signal) obtained by dividing one ENC signal by the number of divisions N into subdivisions is generated by the signal generator 121*d* and outputted to the correction processor 122 (refer to FIG. 17).

The number of divisions N set in advance or to be calculated separately is stored in the division quantity determination unit 121*e*. The number of divisions N, being a number used as a reference when generating the subdivided ENC signal, desirably, is a sufficiently large number such as, for example, 64.

Figure 18:
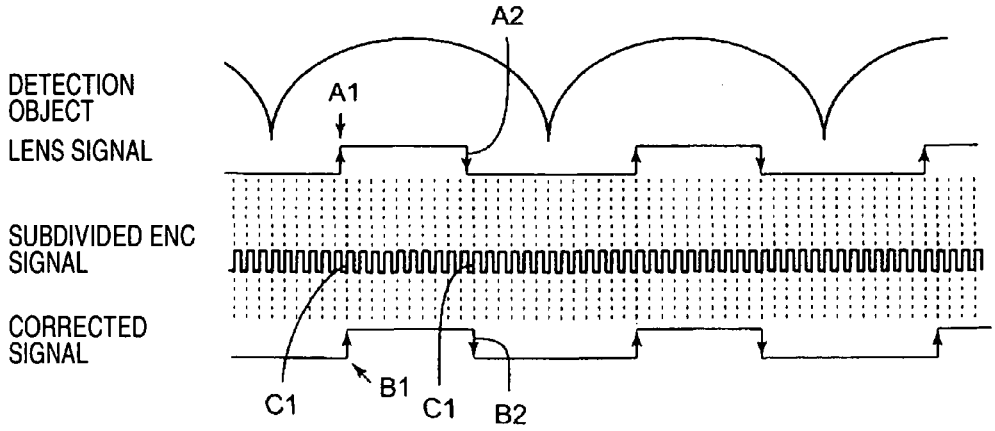
FIG. 18 is a diagram showing an image of a corrected lens signal and a subdivided lens signal.

Also, the subdivided ENC signal generated by the heretofore described signal generator 121*d* and the lens signal generated by the heretofore described binarization processor 93 are inputted into the correction processor 122. As shown in FIG. 18, the correction processor 122, in a case of detecting positive edges C1 of the subdivided ENC signal immediately after having detected a positive edge A1 of the lens signal, generates a Hi signal and outputs the Hi signal. Also, the correction processor 122, in a case of detecting a negative edge A2 of the lens signal and detecting the positive edges C1 of the subdivided ENC signal, generates a Low signal and outputs the Low signal. In this way, it follows that a positive edge B1 of the corrected lens signal is formed a short time after the positive edge A1 is detected. Also, it follows that a negative edge B2 of the corrected lens signal is formed a short time after the negative edge A2 is detected.

As in a case in which an amount of 64 cycles of the subdivided ENC signal corresponds to an amount of one cycle of the corrected lens signal and a like case, it is desirable that the corrected lens signal has a sufficiently longer cycle than the subdivided ENC signal. Also, in the description heretofore, after the positive edge A1 and/or the negative edge A2 is detected, the switching of the corrected lens signal to Hi and/or Low is carried out after the positive edges C1 of the subdivided ENC signal are detected. However, in the event that the negative edge of the subdivided ENC signal is detected after the positive edge A1 and/or the negative edge A2 of the lens signal is detected, it is acceptable to carry out the switching of the corrected lens signal to Hi and/or Low.

In the above way, the correction processor 122 outputs, to the heretofore described pseudo ENC signal output mechanism 110, a new corrected lens signal which, being configured of the Hi and/or Low signal, has the positive edge C1 of the subdivided ENC signal as a reference for the switching to the Hi and/or Low, and the pseudo ENC signal output mechanism 110 generates the pseudo ENC signal using the corrected lens signal. Also, the pseudo ENC signal outputted from the pseudo ENC signal output mechanism 110 is inputted into the ejection controller 130. The ejection controller 130, corresponding to the control means, multiplies the pseudo ENC signal by a prescribed multiple, and generates the timing signal PTS (Print Timing Signal). Also, the ejection controller 130, based on the timing signal PTS, carries out a timing control over a drive signal separately supplied to the print head 32.

Figure 19:
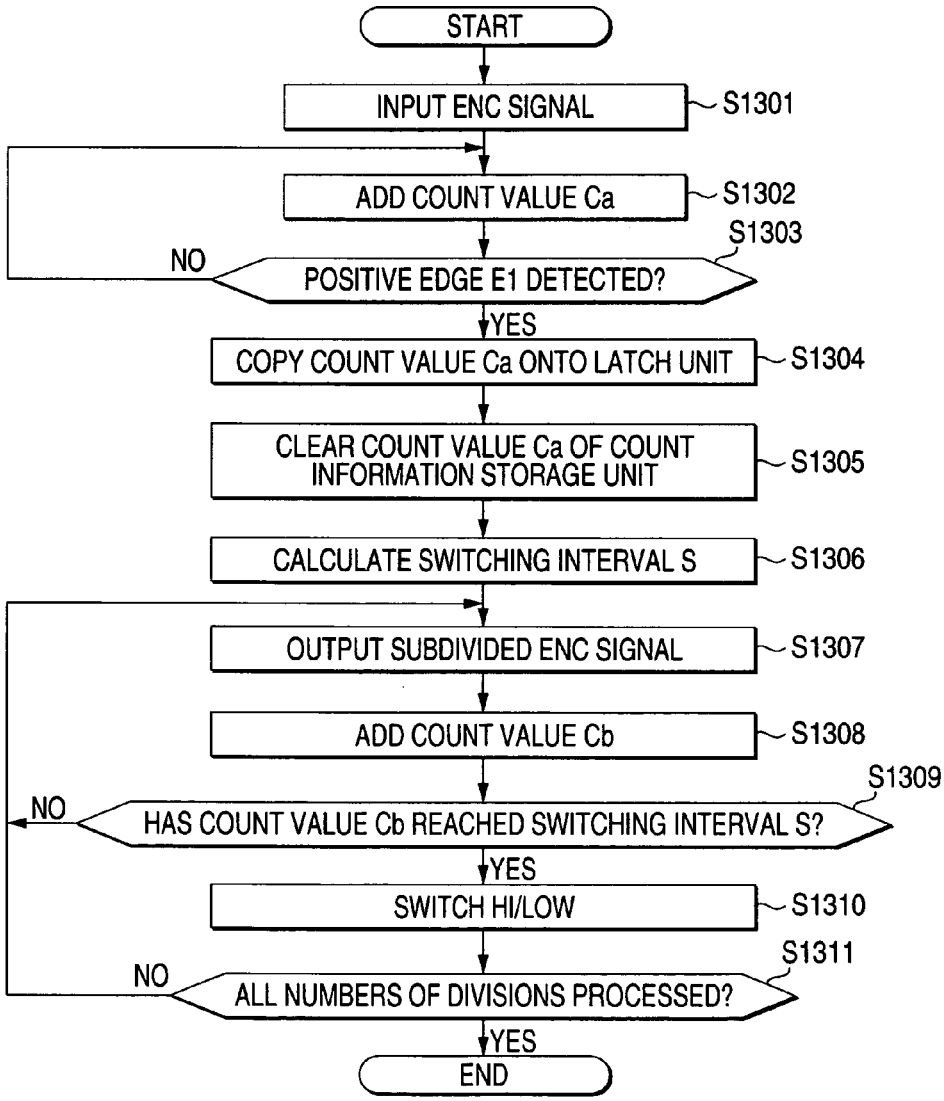
FIG. 19 shows a process flow of generating the subdivided ENC signal.
Figure 20:
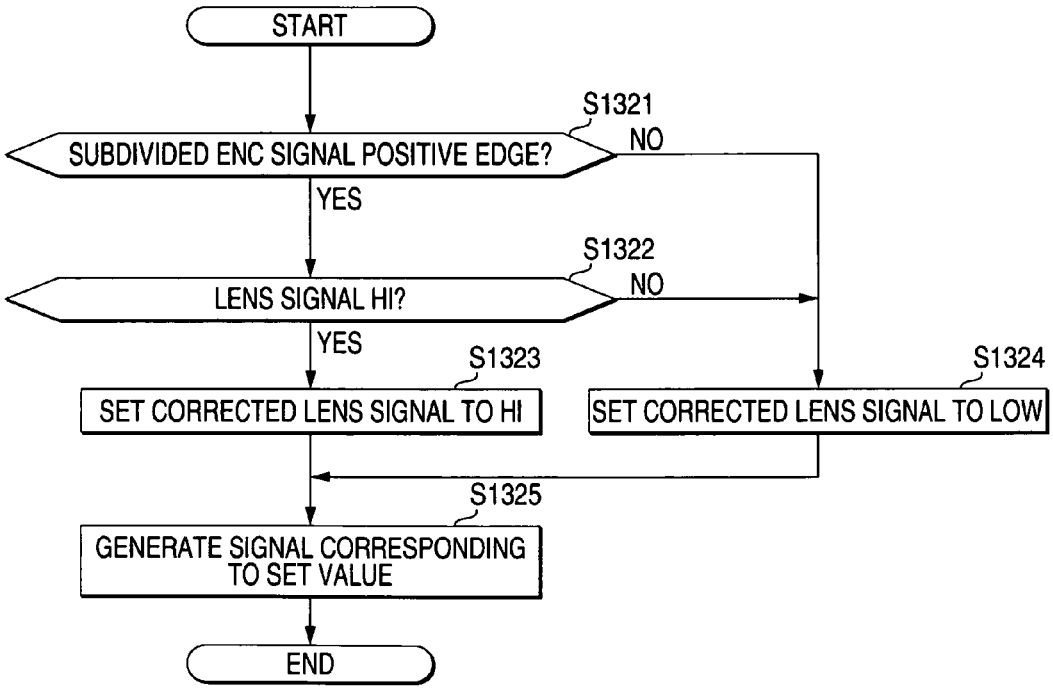
FIG. 20 shows a process flow of generating the corrected lens signal.

A description will hereafter be given, based on the flows in FIGS. 19 and 20, of a generation of the subdivided ENC signal and a generation of the corrected lens signal in a case of operating the printer using the above kind of configuration.

<Generation of Subdivided ENC Signal>

FIG. 19 shows a process flow of generating the subdivided ENC signal. To give a description based on FIG. 19, a clock signal for synchronizing each portion is outputted by a not-shown oscillator furnished on the printer 10. Although the clock signal is also inputted into the count controller 121*a*, furthermore, the ENC signal is also inputted into the count controller 121*a* (S1301). At this point, every time the positive edge of the clock signal is detected, the count controller 121*a* outputs updated information to the count information storage unit 121*b*, and increases the count value Ca stored in the count information storage unit 121*a* by +1 at one time (S1302).

Also, after a clock signal count start, the count controller 121*a* judges whether or not the positive edge E1 of the ENC signal has been detected (S1303). If it is judged in the judgment that the positive edge E1 has been detected (in a case of Yes), the count controller 121*a* moves to S1304 and, if it is judged that no positive edge E1 has been detected (in a case of No), it returns to the heretofore described S1302.

In the case of Yes in S1303, the count controller 121*a* transmits the count value Ca stored in the count information storage unit 121*b* to the latch unit 121*c* (S1304). Also, after the transmission, it clears the count Ca stored in the count information storage unit 121*b* (S1305).

Next, an interval S of the switching between Hi and Low of the subdivided ENC signal is obtained (S1306). To describe the details, firstly, the count value Ca stored in the latch unit 121*c* is read by the signal generator 121*d*. In addition, the signal generator 121*d* reads the number of divisions N (for example; N=10 or the like) set in advance by the division quantity determination unit 121*e*. Then, the count value Ca is divided by the number of divisions N, and the division value S is calculated. For example, in the event that, as well as the number of divisions N=10, a count value Ca obtained by a counting between the positive edges of the ENC signal results in 10000, in consideration of the negative edge E2 of the ENC signal too, the switching interval S is obtained as 500 from 10000/10×2. By the above means, the switching interval S can be obtained.

Figure 17:
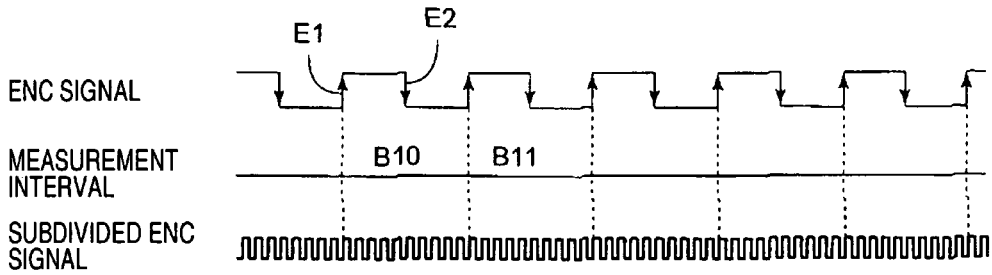
FIG. 17 is a diagram showing an image of generating a subdivided ENC signal based on an ENC signal.

After such a switching interval S is obtained, output of the subdivided ENC signal is started (S1307; refer to FIG. 17). To continue, the signal generator 121*d* carries out a counting of the clock signals, and carries out a calculation (an addition) of the count value Cb (S1308). Then, it is judged whether or not the count value Cb has reached the heretofore described switching interval S (S1309). If it is judged in the judgment that it has reached the switching interval S (in a case of Yes), the flow moves to the next S1310. Also, if it is judged that it has not reached the switching interval S (in a case of No), the flow returns to the heretofore described S1307.

In the case of Yes in S1309, the signal generator 121*d* switches signals to be outputted (S1310). Supposing, for example, that the signal generator 121*d* outputs the Low signal at a stage preceding the stage at which it is judged that the count value Cb reaches the switching interval S, if it is judged that it has reached the switching interval S, the Low signal is switched to the Hi signal. Next, it is judged whether or not all the number of divisions N have been processed (S1311). In the above way, based on the ENC signal, the subdivided ENC signal is outputted. At this time, the signal generator 121*d*, for example, by outputting a Hi/Low signal, of which a count value of 10000 corresponds to one cycle of the ENC signal, for every count value of 500, can output a subdivided ENC signal of which one cycle corresponds to 1000.

<Generation of Corrected Lens Signal>

FIG. 20 shows a process flow of generating the corrected lens signal. As shown in FIG. 20, in order to generate the corrected lens signal, it is judged whether or not an input subdivided ENC signal is the positive edge (S1321). If it is judged in the judgment that it is the positive edge (in a case of Yes), the flow moves to S1322 and, if it is judged that it is not the positive edge (in a case of No), the flow moves to S1324. In the case of Yes in the heretofore described S1321, to continue, it is judged whether or not the lens signal is Hi (S1322). If it is judged that the lens signal is Hi (in a case of Yes), to continue, the flow moves to S1323, and the corrected lens signal is set at Hi (S1323). On the contrary, if it is judged that the lens signal is not Hi (in a case of No), the flow moves to S1324, and the corrected lens signal is set at Low (S1324).

Also, if the flow has passed through the processes in S1323 and S1324, a signal corresponding to a set value is generated (S1325). The signal corresponding to the set value refers to the corrected lens signal set at Hi or Low in the heretofore described S1323 and S1324. In the above way, the corrected lens signal is generated.

According to the printer 10 having this kind of configuration, the corrected lens signal obtained by correcting the lens signal by means of the correction processor 122 based on the subdivided ENC signal obtained by subdividing the ENC signal is outputted. For this reason, by the lens signal being corrected based on the ENC signal-based subdivided ENC signal, the corrected lens signal generated based on the subdivided ENC signal acts as a reference for a drive timing of the print head 32 or the like. For this reason, it is possible to prevent an occurrence of a problem in that an operation stability cannot be obtained due to the drive timing of the print head 32 or the like not matching the lens signal.

Also, as the corrected lens signal is created based on the subdivided ENC signal, and the pseudo ENC signal is created based on the corrected lens signal, the signal switching between the ENC signal and the pseudo ENC signal is smoothened in a drive portion such as the print head 32.

Also, the pseudo ENC signal outputted from the pseudo ENC signal output mechanism 110 is inputted into the ejection controller and, subsequently, the print head 32 is controlled and driven by the ejection controller 130. By that means, when the printing is carried out, it is possible to drive the print head 32 in the same cycle as that of the ENC signal. In addition, while reflecting the detected lens resolution, it is possible to execute the printing on the lens sheet 12 based on the ENC signal-based subdivided lens signal. For this reason, it is possible to realize a high resolution printing while guaranteeing a proper operation.

Although each embodiment of the invention has heretofore been described, the invention can be modified in various ways. Hereafter, a description will be given of the modifications.

In the heretofore described second embodiment, a description is given of a case in which the ENC signal is subdivided in the linear encoder 80, and the lens signal is corrected. However, the invention can obviously be applied to not only the linear encoder, but also the rotary encoder 172. In a case of applying the invention to the rotary encoder 172, it follows that the rotary encoder 172 corresponds to the encoder signal output means. Also, in this case, instead of a condition in which the longitudinal direction of the convex lenses 12A1 extends along the sub-scanning direction, a condition in which it extends along the main scanning direction is desirable. In a case of this kind of configuration, it is acceptable that an ENC signal is outputted by detecting a line pattern on the scale 172*a* of the rotary encoder 172, a pseudo ENC signal is outputted based on a further detected lens signal, the same score as the abovementioned is calculated, and a pseudo ENC signal to be selected is determined from a correlation between the relevant score and the correlation value.

Also, in each heretofore described embodiment, only one lens detection sensor 60 is provided in a portion away from the home position. However, the number of lens detection sensors 60 not being limited to one, it is acceptable to provide a plurality of the lens detection sensors 60 on the carriage 30. For example, in a case of attaching the lens detection sensor 60 to each end in the main scanning direction on the lower surface of the carriage 30, in each of the backward and forward movements of the carriage 30, it is possible to measure the lens pitch (the lens resolution) prior to the printing, and it is possible to realize a printing on the lens sheet 12 for each of the backward and forward movements.

Also, in each heretofore described embodiment, as well as the ENC signal and the lens signal being pulse signals, the encoder cycle information and/or the lens cycle information serves as the positive edge and/or negative edge thereof. However, it is acceptable that the ENC signal and the lens signal are analog signals. In a case in which they are the analog signals, in the event that the encoder cycle information and/or the lens cycle information is used as a prescribed voltage threshold, it is possible to calculate the count value or the like.

Also, in each heretofore described embodiment, the lens sheet 12 has a configuration in which a large number of convex lenses 12A1 are arrayed but, the lens sheet not being limited to this, a lens sheet having a configuration in which a large number of concave lenses are arrayed is acceptable. In this case, it is preferable that, rather than the positive edge, the time the negative edge is detected is taken as a reference in each heretofore described process.

Also, in each heretofore described embodiment, the printer 10 is not limited to one which carries out only the printing, and a complex printer combining copy, fax and scanner functions is acceptable. Also, in the heretofore described embodiments, a description is given of a case of a drawing type which directly prints a print image on the lens sheet 12. However, it is also obviously possible to apply the invention to a case of a discrete type in which a separately printed matter is attached to the lens sheet.

The present application claims the benefits of Japanese Patent Application No. 2005-320463 filed in Japan on Nov. 4, 2005 and Japanese Patent Application No. 2006-017365 filed in Japan on Jan. 26, 2006, the subject matters of which application are incorporated herein by reference.

What is claimed is:

1. A printer for executing a printing on a lens sheet in which a plurality of lenses is disposed, comprising:

a lens detection element which, by scanning the lens sheet, is configured to ouput a lens signal corresponding to a lens resolution of the lenses in the lens sheet;

an encoder signal output element which, by scanning a scale, is configured to output an encoder signal in accordance with a pattern provided on the scale;

a lens signal counting element which is configured to calculate first elapsed time information regarding a cycle of the lens signal;

an encoder signal counting element which is configured to calculate second elapsed time information regarding a cycle of the encoder signal; and a lens signal division element which, based on the first elapsed time information and the second elapsed time information, is configured to divide the lens signal and outputs a divided lens signal.

2. The printer according to claim 1, wherein the lens signal division element includes:

a signal division processor which, by dividing the first elapsed time information by each of a plurality of integers, is configured to output the divided lens signal corresponding to each integer;

a score calculator which is configured to calculate a score which is a ratio of the first elapsed time information to the second elapsed time information; and a signal selector which, based on the score calculated by the score calculator, is configured to select the integer corresponding to the score from among a plurality of the divided lens signals, and selects and outputs the divided lens signal corresponding to the integer.

3. The printer according to claim 2, wherein, the lens signal division element includes:

a correlation recorder which is configured to store a first table showing a correlation between the score and the lens resolution of the lens sheet;

a searcher which is configured to search for a value of the lens resolution corresponding to the score from inside the first table; and a result recorder which is configured to store a search result searched by the searcher, and the signal selector, based on the search result stored in the result recorder, selects the integer.

4. The printer according to claim 2, wherein, the lens signal division element includes:

a correlation recorder which is configured to store a second table showing a correlation between the score and a number of divisions;

a searcher which is configured to search for the number of divisions corresponding to the score from inside the second table; and a result recorder which is configured to store a search result searched by the searcher, and the signal selector reads the integer stored in the result recorder, and selects the divided lens signal.

5. The printer according to claim 1, wherein the lens signal, after being corrected by a lens signal corrector based on a subdivided encoder signal obtained by dividing the encoder signal, is divided by the lens signal division element, generating the divided lens signal.

6. The printer according to claim 5, wherein the lens signal corrector includes:

an ENC subdivision processor into which the encoder signal is inputted and which is configured to output the subdivided encoder signal; and a correction processor into which the subdivided encoder signal is inputted and which is configured to correct the lens signal based on the inputted subdivided encoder signal and outputs a corrected lens signal.

7. The printer according to claim 6, wherein the lens signal division element and the ENC subdivision processor, based on a counting of clock signals, output the divided lens signal and the subdivided encoder signal.

8. The printer according to claim 1, wherein, the encoder signal output element is a linear encoder for carrying out a position detection in a main scanning direction of a print head which ejects ink droplets toward the lens sheet, and the scale is a linear scale disposed along the main scanning direction, and the lens detection element, while moving in the main scanning direction in conjunction with the linear encoder, detects the lens resolution of the lenses in the lens sheet along the main scanning direction.

9. The printer according to claim 2, wherein, the divided lens signal outputted after being selected by the signal selector is inputted into a controller, and the controller controls a drive of the print head which ejects ink droplets toward the lens sheet.

10. The printer according to claim 1, wherein the lens detection element includes: a light emitter which is configured to emit light toward the lens sheet, and which is provided opposite a carriage across the lens sheet in a condition in which the lens sheet is transported; and a light receiver which is attached to the carriage, in which the light transmitted through the lens sheet is entered after being emitted from the light emitter, and which is configured to output a detection signal corresponding to an intensity of the incident light.

11. A printing method for executing a printing on a lens sheet in which a plurality of lenses is disposed, comprising:

by scanning the lens sheet, outputting a lens signal corresponding to a lens resolution of the lenses in the lens sheet;

by scanning a scale, outputting an encoder signal in accordance with a pattern provided on the scale;

calculating first elapsed time information on a cycle of the lens signal;

calculating second elapsed time information on a cycle of the encoder signal; and, based on the first elapsed time information and the second elapsed time information, dividing the lens signal and outputting a divided lens signal.

* * * * *